US006155360A

United States Patent [19]

McLeod

[11] Patent Number: 6,155,360

[45] Date of Patent: Dec. 5, 2000

[54] RETRACTABLE DRILL BIT SYSTEM

[75] Inventor: Gavin Thomas McLeod, Ardross, Australia

[73] Assignee: DHT Technologies, Ltd., Perth, Australia

[21] Appl. No.: 09/253,743

[22] Filed: Feb. 22, 1999

[30] Foreign Application Priority Data

Oct. 29, 1998 [AU] Australia ..... PP6838

[51] Int. Cl.[7] ..... E21B 10/64; E21B 10/66

[52] U.S. Cl. ..... 175/258; 175/257

[58] Field of Search ..... 175/257, 258, 175/259

[56] References Cited

U.S. PATENT DOCUMENTS 3,603,413 9/1971 Link et al. .
4,878,549 11/1989 Bennet ..... 175/258
5,271,472 12/1993 Leturno .
5,662,182 9/1997 McLeod et al. .

*Primary Examiner*—Brian L. Johnson
*Assistant Examiner*—Joselynn Z. Sliteris

[57] ABSTRACT

A retractable drill bit system for a ground drill includes drill bit assembly, a bit assembly sleeve, and a transport member. The drill bit assembly is engagable with a drive sub attached to the bottom of the ground drill with the drill bit assembly being selectively expandable and collapsible between a transport position in which the drill bit assembly is transported through the ground drill by the sleeve and transport member and a cutting position in which the drill bit assembly locks into the drive sub and cuts the hole. The drill bit assembly in the cutting position is able to cut a hole substantially greater than the diameter of the ground drill itself. The drill bit assembly includes a circular bit attached at a lower most end of the sleeve and bit segments retained in slots formed in the sleeve. Each segment is provided with a lever that extends radially inwardly of the sleeve and engages the transport member. The transport member is arranged coaxially with and extends inside the sleeve, with the transport member or sleeve being resiliently coupled together to allow relative linear sliding motion. The lower end of the bit assembly sleeve extends beyond a lower end of the transport member. The drill bit assembly is coupled to the bit assembly sleeve and transport member so that linear motion of the lower ends of the sleeve and the transport member urges the segments radially outwardly from engagement of the levers with the transport member.

15 Claims, 22 Drawing Sheets

26
30
38
40
18
44
48
42
54
50
52
22
66
68
72
70
56
16
60
64
58
62
65
20

RETRACTABLE DRILL BIT SYSTEM

BACKGROUND OF THE INVENTION

The present invention relates to a retractable drill bit system particularly, although not exclusively, for use in oil and gas drilling.

In most forms of ground drilling a drill bit is attached to a lower end of a drill string and the drill string rotated at the ground level to drill a hole in the ground. To increase the depth of the hole being drilled, drill rods are sequentially and individually screwed onto the ground end of the drill string.

There are obvious commercial and technical advantages in being able to change the drill bit when necessary without the need to pull the drill string from the ground. The present applicant has been particularly innovative in the design of a retractable drill bit system for core or diamond drilling. Such a system is described in the applicant's International Application No PCT/AU94/00322 (WO 94/29567). In that system, the core drill bit is segmented into separate fingers and transported to and from the end of the ground drill by use of a running tool. The tool also operates an internal bit locking sleeve that can slide up and down a drive sub attached to the end of the drill string for locking the fingers in place and subsequently releasing them to collapse back on to the tool for retrieval. Once the fingers have been locked in place the tool is removed and a core barrel lowered in to the drill string in the conventional manner and the drill operated to cut a core.

This system has proved to be very successful. Nevertheless, the system is largely limited to drilling applications where the diameter of the drill pipe is similar (marginally smaller) than the diameter of the hole being drilled by the drill bit at the end of the drill pipe. Also that system does not totally eliminate time lost to change the bit, as tripping the running tool for retrieving and installing the bit will consume valuable drill time. It is these limitations that have lead to the development of the present invention.

SUMMARY OF THE INVENTION

According to the present invention there is provided a retractable drill bit system for a ground drill having a drive sub attached to a lower end thereof, the system including:

a drill bit assembly engagable with the drive sub for cutting a hole, the drill bit assembly expandable and collapsible between a transport position in which the drill bit assembly can be transported through the ground drill and a cutting position in which the drill bit assembly is engaged in the drive sub and can cut said hole;

a bit assembly sleeve for carrying the drill bit assembly; and, a transport member arranged coaxially with and extending inside the bit assembly sleeve, the transport member and sleeve resiliently coupled together to allow relative linear sliding motion therebetween with a lower end of the bit assembly sleeve extending beyond a lower end of the transport member, the transport member adapted for lowering into and retrieval from the ground drill and releasably lockable to the ground drill when it reaches a predetermined location within the ground drill;

the drill bit assembly operatively associated with the bit assembly sleeve and the transport member in a manner so that linear motion of the lower ends of the sleeve and transport member toward each other urges the drill bit assembly toward the cutting position and linear motion of the lower ends away from each other urges the drill bit assembly toward the transport position;

whereby the drill bit assembly can be transported in the transport position through the ground drill to the drive sub and on the transport member reaching the predetermined location said lower ends of the sleeve and member are moved toward each other to expand the drill bit assembly to the cutting position and into engagement with the drill sub to enable drilling to proceed. and wherein the drill bit assembly is collapsed to the transport position by pulling upwardly on the transport member causing the lower ends to move away from each other to enable the drill bit assembly to be retrieved with the transport member.

Preferably the sleeve is of a length so that, with the ground drill lifted off the bottom of a hole being drilled, the lower end of the sleeve extends below the drive sub when the transport member is in the predetermined location, whereby on lowering the ground drill to the bottom of the hole the sleeve is forced backwards relative to transport member resulting in the lower ends of the sleeve and member being moved toward each other and expanding the drill bit assembly to the cutting position and into engagement with the drill sub.

Preferably the system includes stop means acting between the sleeve and the ground drill to stop motion of the sleeve toward the drive sub prior to the transport member reaching the predetermined location so that continued motion of the transport member toward the predetermined location causes the lower ends of the sleeve and member to move toward each other initiating expansion of the drill bit assembly toward the cutting position.

Preferably said stop means is a mule shoe which further acts to axially position the transport member so that the drill bit assembly locates in seats formed in the drive sub.

Preferably the drill bit assembly includes a first cutting means of a fixed diameter attached to the lower end of the sleeve and second cutting means selectively expandable and collapsible between the transport position and cutting position.

Preferably said second cutting means includes a plurality of bit fingers coupled to the bit assembly sleeve and engaging the transport member so that relative linear motion of the lower ends of the sleeve and member towards each other urges the drill bit assembly into the cutting position and relative linear motion of said ends of the sleeve and transport member away from each other urges the drill bit assembly into the transport position.

Preferably the second cutting means is coupled to the bit assembly sleeve by a resiliently radially expandable ring located about a reduced diameter portion of the bit assembly sleeve whereby the ring and the second cutting means can slide along said reduced diameter portion when said bit assembly sleeve and transport member slide relative to each other.

Preferably each finger is provided with a recess for seating said ring.

Preferably each recess is provided with first and second regions spaced by a rise whereby the ring is located in the first region when the second cutting means are in the transport position and the ring can snap over the rise into the second region and when the second cutting means is expanding to the cutting position.

Preferably each finger is provided with a lever formed on the side of each finger opposite the recess, the lever engaging the transport member so that linear motion of the transport member relative to the bit assembly sleeve can urge the fingers to pivot between the cutting position and the transport position.

In one embodiment the lever is resilient. In this embodiment, the lever can be in the form of a leaf or bow spring coupled to each finger. However, in an alternate embodiment the lever can be a projection or lug formed integrally with the fingers.

Preferably the second cutting means and the bit assembly sleeve are provided with complimentary inclined surfaces that abut when the second cutting means is in the cutting position, said complimentary inclined surfaces configured so that forces acting inwardly along the length of the fingers during drilling tend to wedge the fingers between the drive sub and the bit assembly tube.

Preferably the sleeve and transport member are resiliently coupled by a spring that is in a state of compression when the second cutting means is in the cutting position and acts to urge the lower ends of the hit assembly sleeve and the transport member to move away from each other and thus the second cutting means into the transport position.

Preferably said system includes means for releasably locking the spring in the compressed state when the second cutting means is in the cutting position.

Preferably said means for releasably locking the bias means includes one or more locking balls carried in the bit assembly sleeve, a recess formed on an inner circumferential surface of the drive sub, and a raised lip formed circumferentially about an outer circumferential surface of the transport member wherein when the transport member is locked at said predetermined position within the drill string said lip is located opposite the recess so that as the bit assembly sleeve is pushed backwards into the drill string by a lowering of the ground drill onto the bottom the hole being drilled the balls role or slide along the transport member and abut the raised lip momentarily pushing the transport member upwardly so that the balls can ride over the raised lip and partially locate in the recess and against the lip to hold said bit assembly sleeve in position and said spring in the compressed state.

Preferably said transport member comprises a standard inner core tube and a core lifter case coupled at a lower end of the inner core tube, with said groove and said lip formed on the outer circumferential surface of the core lifter case.

Preferably said transport member is provided with a spacer sleeve located over the inner core tube, the core lifter case acting as a stop to prevent the spacer sleeve falling off a lower end of the inner core tube and where said spring is disposed about the inner core tube between and upper end of the spacer sleeve and an upper end of the inner core tube to prevent the spacer sleeve slipping off the upper end of the inner core tube.

Preferably there is provided an adaptor coupled to the upper end of the inner core tube for holding said spring on the inner core tube.

Preferably the system further includes torque decoupling means for reducing the transfer of torque from the drive sub to the inner core tube.

Preferably the torque decoupling means comprises an annular bearing disposed about the inner core tube between an upper end of the spacer sleeve and a lower end of the biasing means.

Preferably the torque decoupling means includes a second annular bearing located about the inner core tube between an upper end of the bias means and the adaptor.

In one embodiment, the first cutter means can be in the form of annular bit so that said ground drill can cut a core sample of the ground, the core filling said tubular member. However, in an alternate embodiment, the first cutting means can be in the form of a full face cutter.

BRIEF DESCRIPTION OF THE DRAWINGS

An embodiment of the present invention will now be described by way of example only with reference to the accompanying drawings in which:

FIGS. 14A–E, 15A–F and 16A–F illustrate plan and section views of the system in operation, wherein FIGS. 14E, 15E, 15F, 16E and 16F are enlarged views of FIGS. 14B, 15B, 15D, 16B and 16E, respectively.

DETAILED DESCRIPTION OF THE INVENTION

Figure 1A:
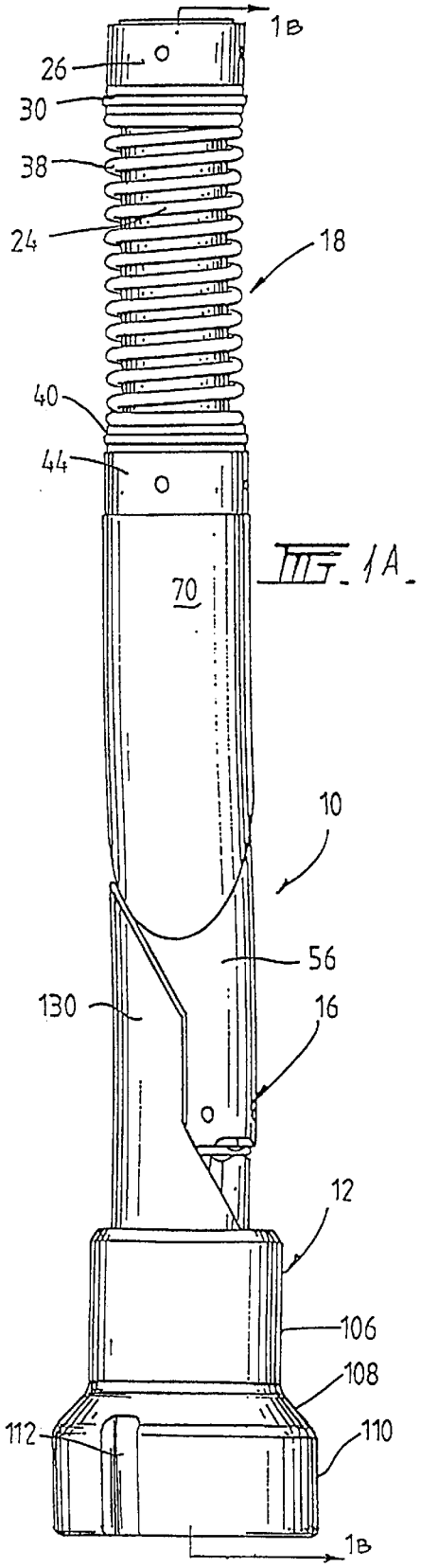
FIG. 1A is a side view of an embodiment of the retractable drill bit system.
Figure 1B:
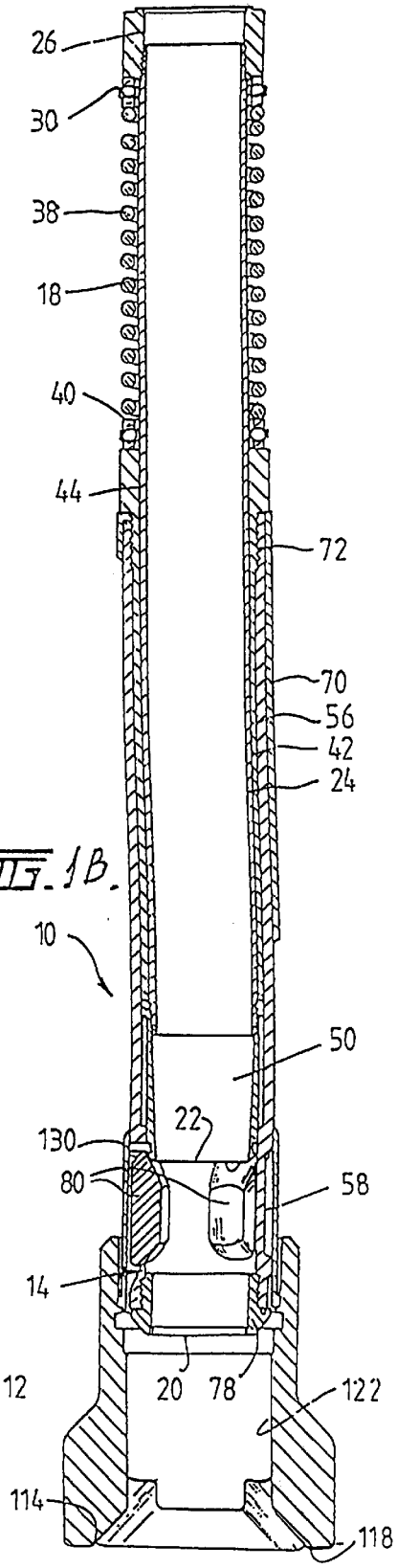
FIG. 1B is a view of section 1B—1B taken through FIG. 1A.
Figure 1C:
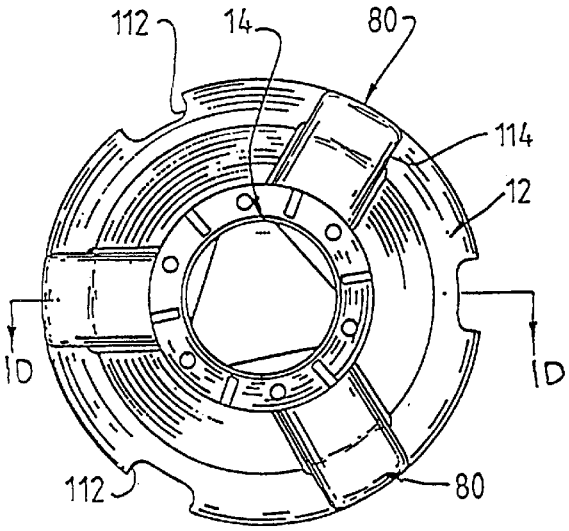
FIG. 1C is an end view of the retractable drill bit system shown in FIG. 1A.
Figure 1D:
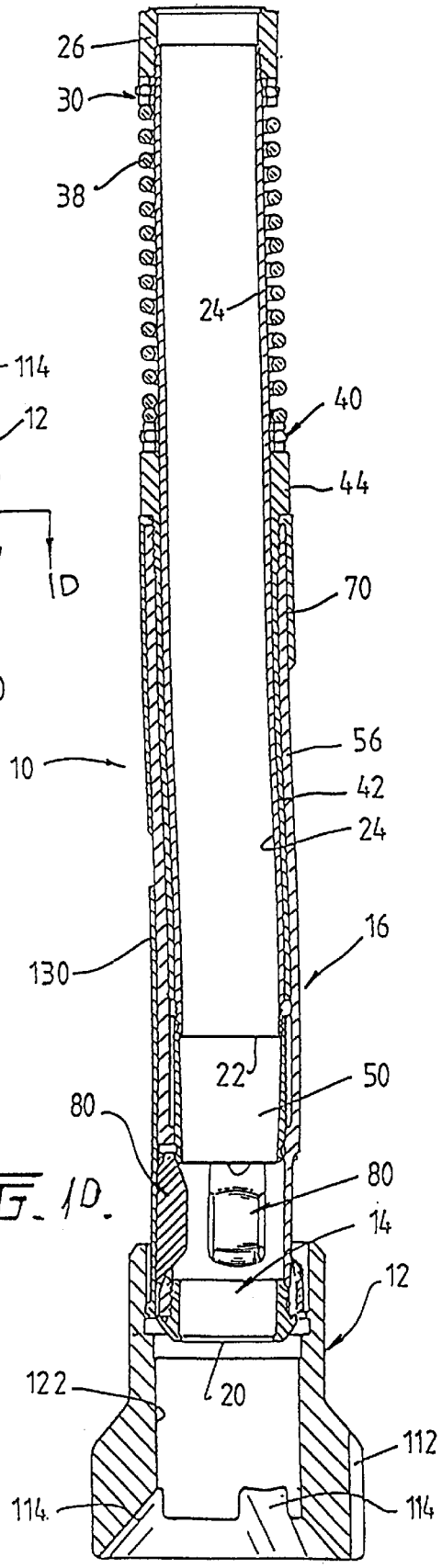
FIG. 1D is a view of section 1D—1D taken through FIG. 1C.

FIGS. 1A–1D illustrate the retractable drill bit system 10 for a ground drill composed of a drill string (not shown) having the drive sub 12 attached to a lower end thereof. The system 10 includes a drill bit assembly 14 engagable with the drive sub 12 for cutting a hole of a diameter greater than the outer diameter of the drill string, the drill bit assembly 14 selectively expandable and collapsible between transport position (shown in FIGS. 1A–1D and 13) in which the drill bit assembly 14 can be transported through the drill string and a cutting position (shown in FIGS. 16A–16F) in which the drill bit assembly can cut the hole. The drill bit assembly 14 is carried on a bit assembly sleeve 16 (see in particular FIGS. 8, 13). Transport member 18 is arranged coaxially with and extends inside the bit assembly sleeve 16. The transport member 18 and sleeve 16 are resiliently coupled to allow relative linear sliding motion therebetween with the lower most end 20 of the sleeve 16 extending beyond the lower most end 22 of the transport member 18. The transport member 18 can be lowered down the drill string and retrieved therefrom in any conventional manner for example by way of a wire line and/or by pumping. In addition, the transport member 18 is adapted for releasably locking to the inside of the drill string when it reaches a predetermined location as it is being lowered. Any conventional locking mechanism/system may be used. This could include for example the conventional back end of a core barrel incorporating the typical inner tube compression spring and compressible rubber shut off valves. Such a system is manufactured by Boart Longyear and described in various manuals relating to their series "Q" and "HD" wireline system. As is understood by those skilled in the art this locking system releasably locks all upper most end of a core barrel to the inside of a drill string but also allows a degree of downward movement of the core tube by virtue of the heavy duty compression spring (this is provided to allow core tube to set on the drill bit during a core breaking operation) and, a degree of upward movement by compression of the rubber shut off valves (that are otherwise used for providing an indication that a core block has occurred). The specific construction and form of the releasable lock does not form part of the present invention and simply incorporates the well known and commonly used back end of a standard core tube.

The drill bit assembly 14 is operatively associated with the sleeve 16 and the transport member 18 in a manner so that linear motion of the ends 20 and 22 toward each other urges the drill bit assembly 14 into the cutting position and linear motion of the ends 20 and 22 away from each other urges the drill bit assembly 14 towards the transport position.

With the drill string lifted off the bottom of a hole being drilled, the drill bit assembly 14 is lowered down the drill string in a transport position by the transport member 18. When the transport member reaches the predetermined position it releasably locks into the drill string. This position is shown generally in FIGS. 15A–15F. As explained in greater detail below, marginally prior to this happening, the sleeve 16 is stopped from downward motion by abutment with a mule shoe attached to the drive sub 12. Therefore, the ends 20 and 22 of the sleeve 16 and Transport member 18 respectively are caused to slide toward each other when the sleeve 16 bottoms out. This initiates a spreading of the drill bit assembly 14 toward the cutting position. When the drills string is then lowered onto the ground, the sleeve 16 contacts the ground and is pushed backwards over the transport member 18 so that its lower end 20 moves towards the lower end 22 of member 18. This further spreads the drill bit assembly 14 into the cutting position and into driving engagement with the drill sub 12 as depicted in FIGS. 16A–16F. When the drill string is rotated the hole is now cut by the drill bit assembly 14. To retrieve a drill bit assembly 14 for replacement, the drill string is lifted marginally from the bottom of the hole being drilled and the transport member 18 unlocked from the drill string and pulled upwardly. This combination of motions causes the lower ends 20 and 22 to move away from each other thereby collapsing the drill bit assembly 14 back to the transport position shown in FIGS. 1 and 14 so that it can be pulled from the drill string with the transport member 18 without the need for pulling the drill string itself from the hole.

The physical construction of the system 10 will now be described in greater detail.

Figure 3:
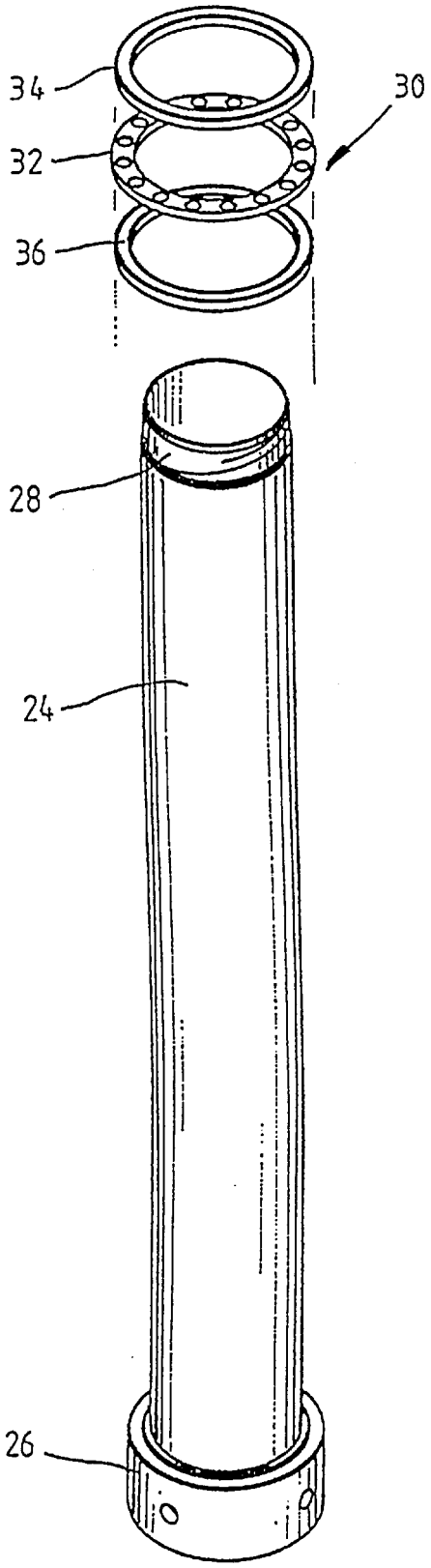
FIGS. 3–13 is a series of perspective drawings illustrating various components of the system in the sequence of construction of the system.
Figure 4:
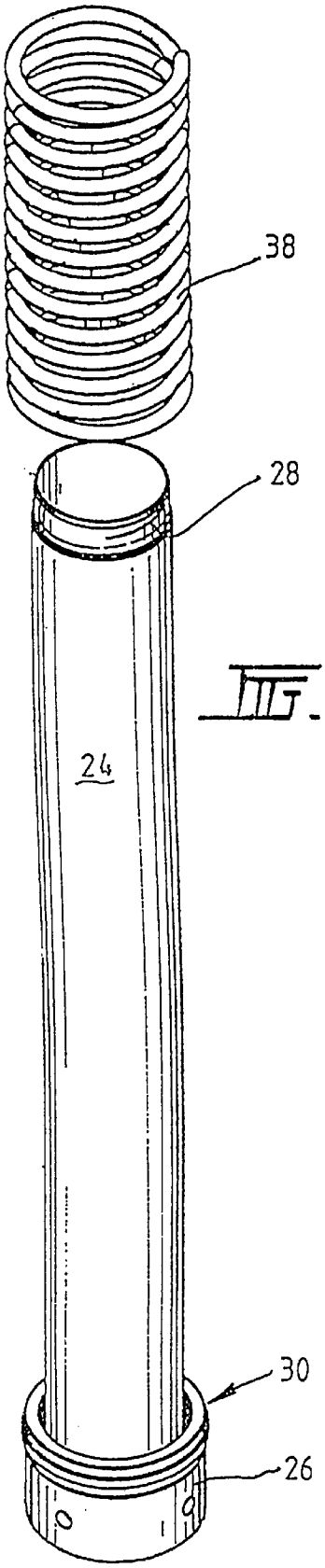
Figure 5:
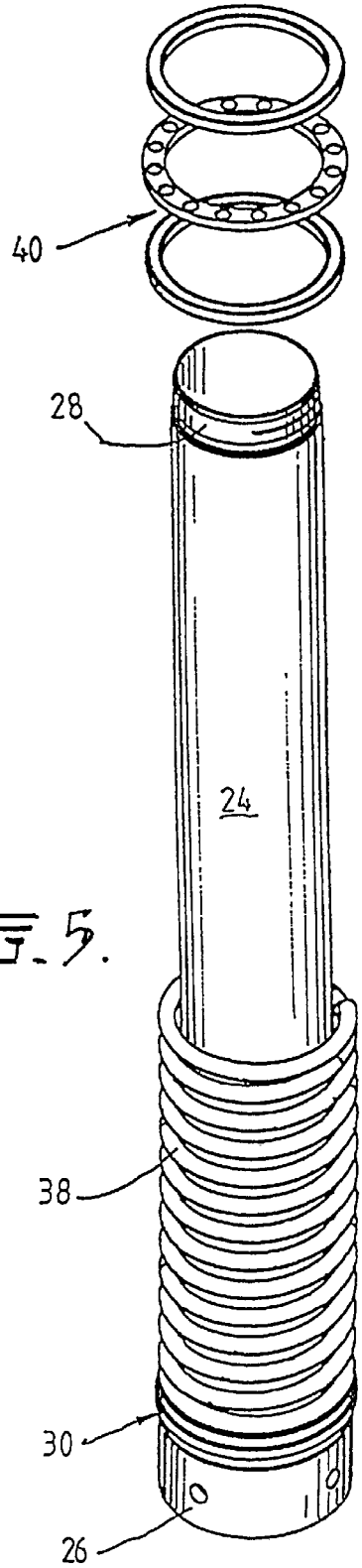

FIG. 3 illustrates a standard inner core tube 24 used for core or diamond drilling. An adaptor ring 26 is screwed onto an outside surface at an upper end of the inner core tube 24. A further inner core tube (not shown) can be screwed onto the adaptor ring 26. An opposite end of the inner core tube 24 is provided with a reduced outer diameter threaded section 28. An annular bearing assembly 30 comprising a central bearing cage 32 and opposite bearing races 34 and 36 is slipped over the core tube 24 and lowered to abut with the adaptor 26 as shown in FIG. 4. A helical spring 38 is slipped over the core tube 24 and sits on the annular bearing 30. The spring 38 has an uncompressed length of approximately ⅔ that of the core tube 24. Referring to FIG. 5, a second annular bearing assembly 40 of identical construction to the bearing assembly 30 is slipped on to the core tube 24 and sits on the free end of the spring 38.

Figures 6, 7:
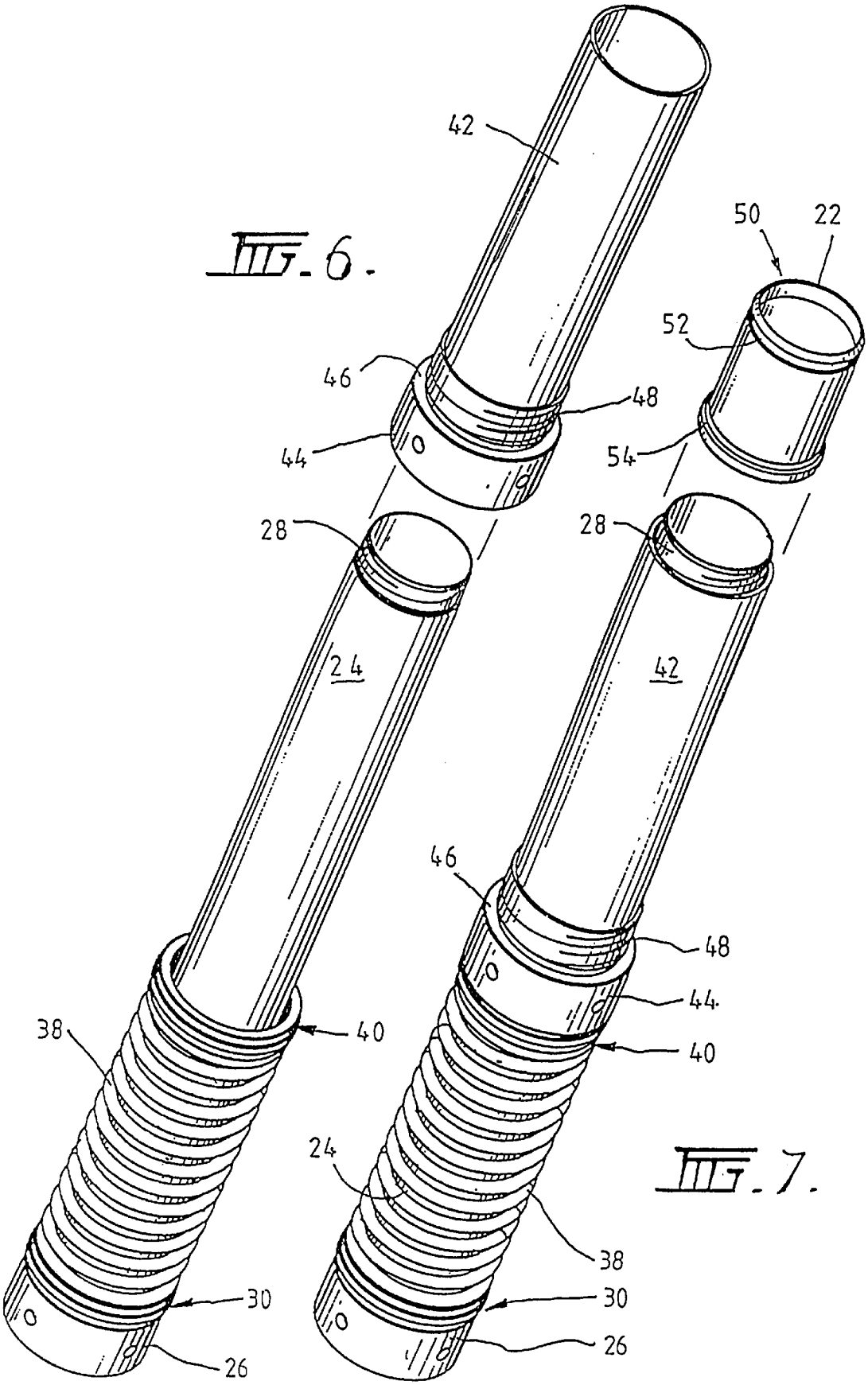

As shown in FIG. 6, a spacer tube 42 is slipped over the inner core tube 24 to sit on the bearing 40. One end 44 of the space 42 is formed with an increased outer diameter thereby forming a seat or shoulder 46 adjacent the remaining length of the spacer 42. A short length of the spacer 42 adjacent the shoulder 46 is provided with a screw thread 48. The spacer 42 is of a length so that when sitting on the bearing 40 the threaded section 28 protrudes therefrom as shown mostly clearly in FIG. 7. This thread 28 is used to facilitate connection with a core lifter case 50. Core lifter cases per se are well known in the art of core drilling and are used for gripping a core during core breaking. In so far as the core breaking function is concerned the core lifter case 50 in the present embodiment functions in exactly the same way as any conventional core lifter case. However, the core lifter case 50 in this embodiment is modified by the inclusion of an annular groove 52 adjacent and inboard of its lower most end 22 and a raised lip 54 formed adjacent its upper end. One of the functions of the lip 54 is to act as a stop for the spacer 42 preventing the spacer 42 from slipping off the inner core tube 24. It will be appreciated that when the core lifter case 50 is screwed onto the threaded section 28 the spacer 42 can be moved along the length of the inner core tube 24 against the spring 38. In addition, the spacer 42 can rotate about the inner core tube 24. The combination of the inner core tube 24, spring 38 and core lifter case 50 forms the transport member 18.

Figure 8:
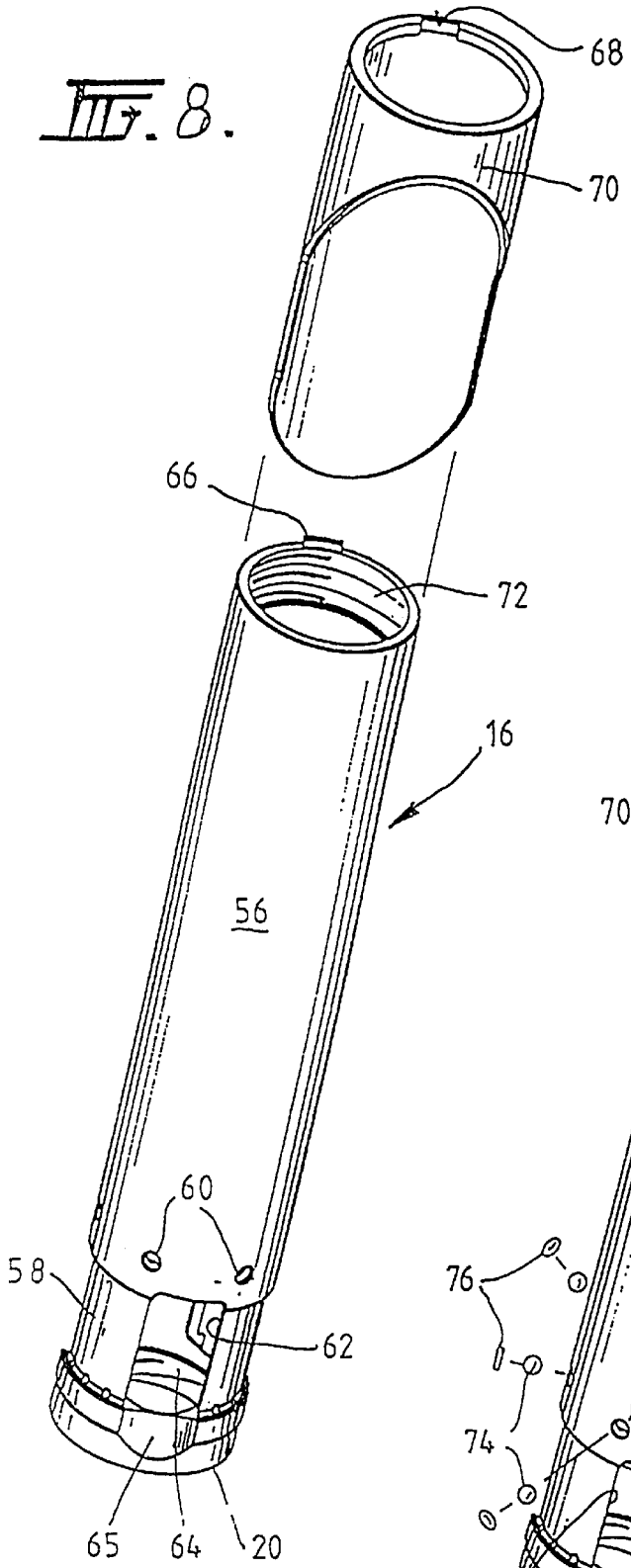

FIG. 8 illustrates the bit assembly sleeve 16. The sleeve is essentially in the form of a tube 56 having a reduced diameter length 58 inboard of and near lower most end 20. A series of evenly spaced holes 60 are formed circumferentially about the tube 56 slightly above the length 58. The length 58 includes three longitudinal slots 62 for receiving part of the drill bit assembly 14. A screw thread 64 is formed on the inside of the sleeve 16 adjacent end 20 for coupling with another component of the drill bit assembly 14. The end of each slot 62 adjacent end 20 is formed with a taper 65 that inclines away from a longitudinal axis of the sleeve 16 in a direction toward the end 20.

Figure 9:
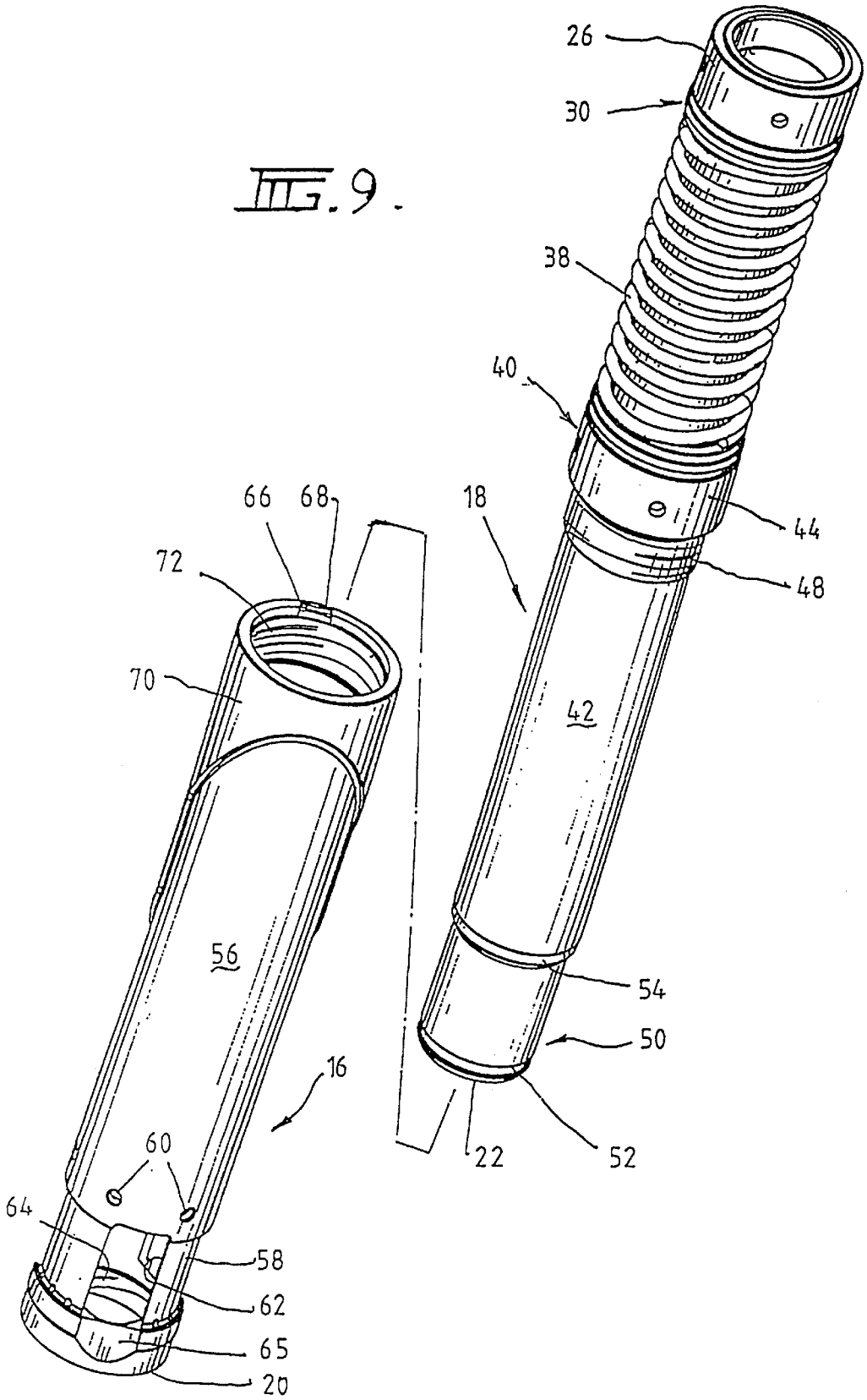
Figure 11:
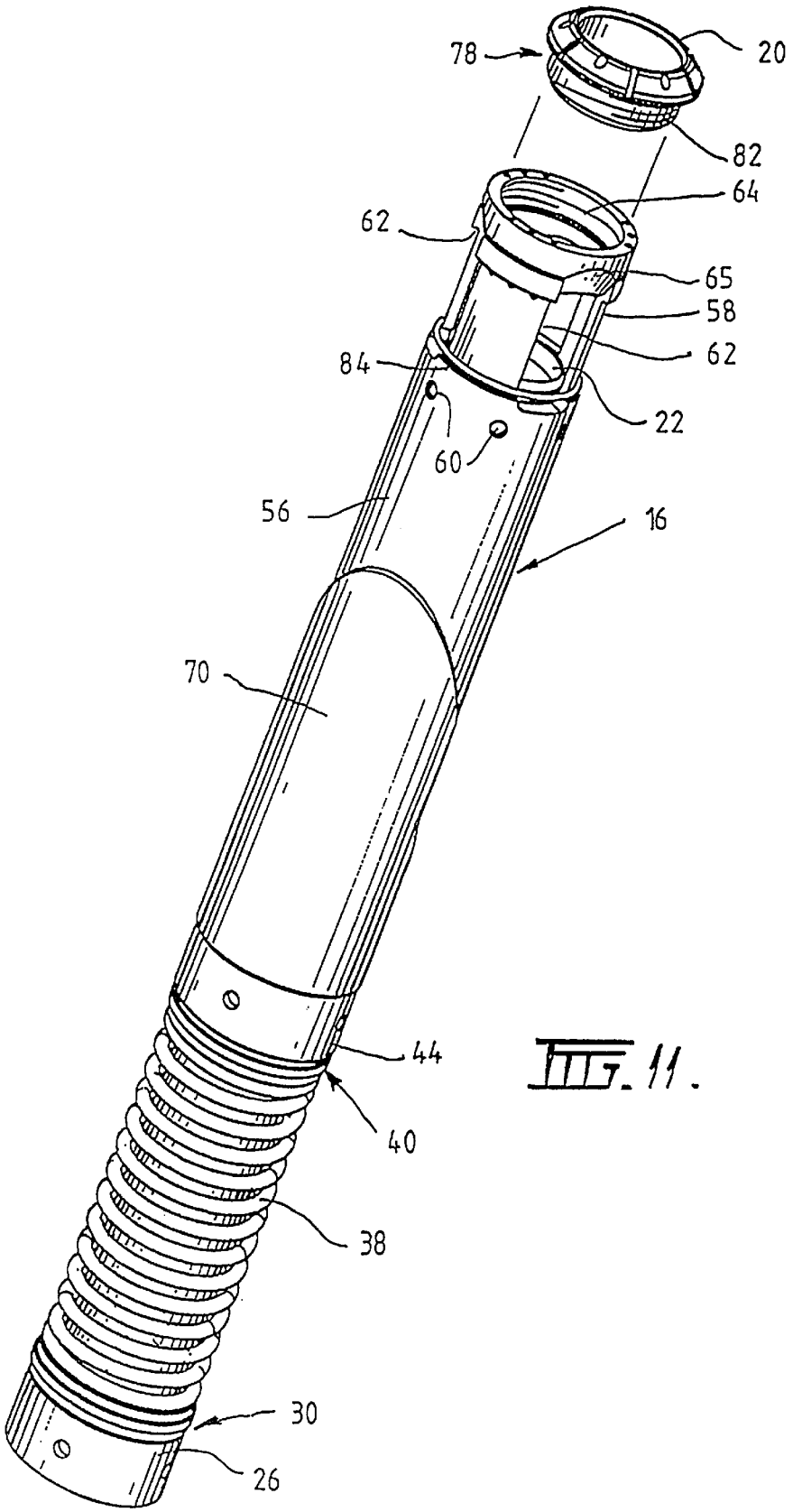
Figure 12:
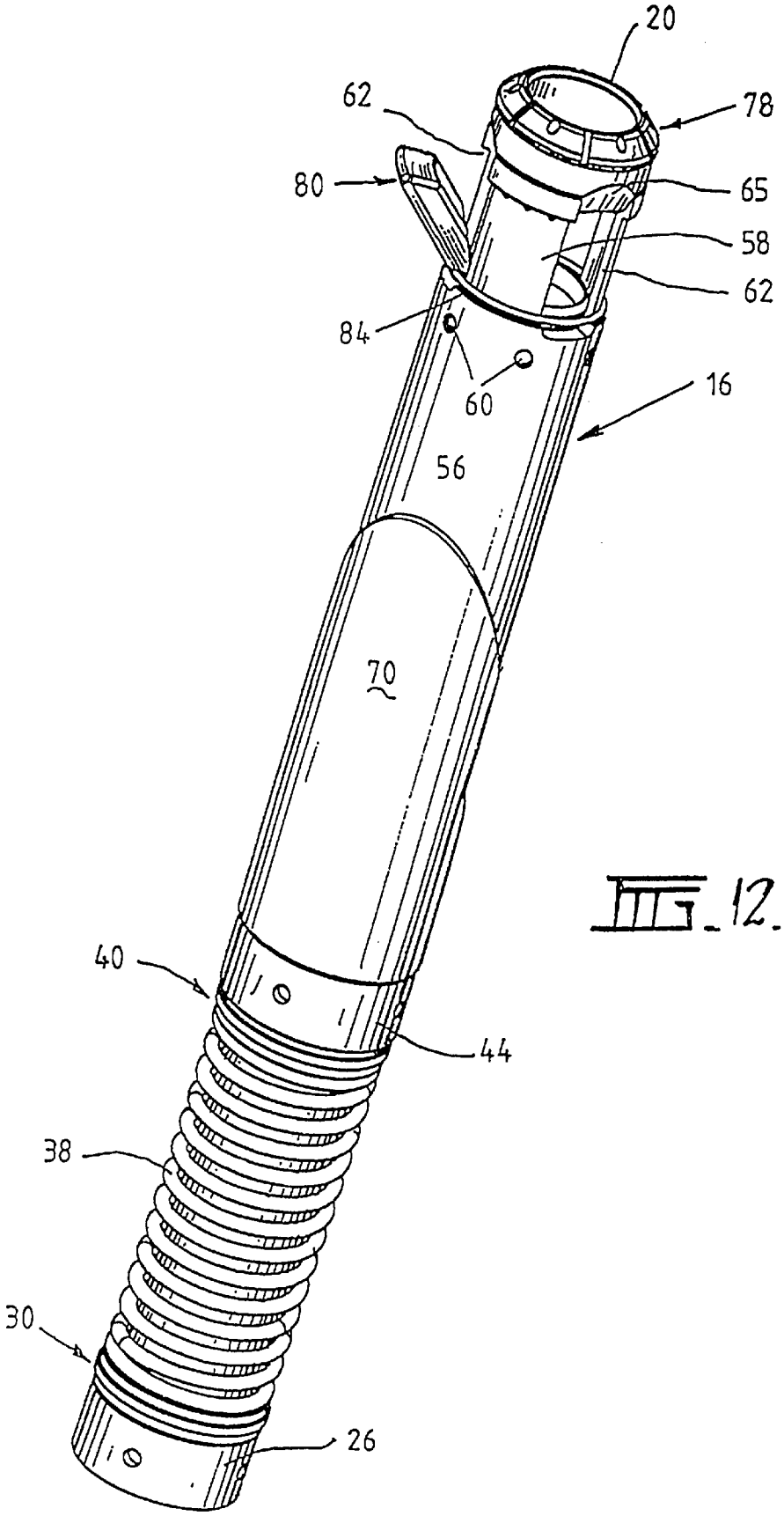

The opposite end of the sleeve 16 is provided with a key 66 for registration with a complimentary recess 68 formed on the inside of a mule shoe 70 that slips over the upper end of the sleeve 16 shown in FIGS. 8 and 9. A short length of the inner circumferential surface of the tube 56 at its upper end is provided with a screw thread 72.

As shown in FIG. 9, the sleeve 16 is coupled to the transport member 18 by engagement of the thread 48 on the spacer 42 with thread 72 on the tube 56. It will be appreciated that this coupling or connection allows the tubular member 18 comprised of the inner core tube 24 and core lifter case 50 to slide linearly relative to the sleeve 16.

Figure 10:
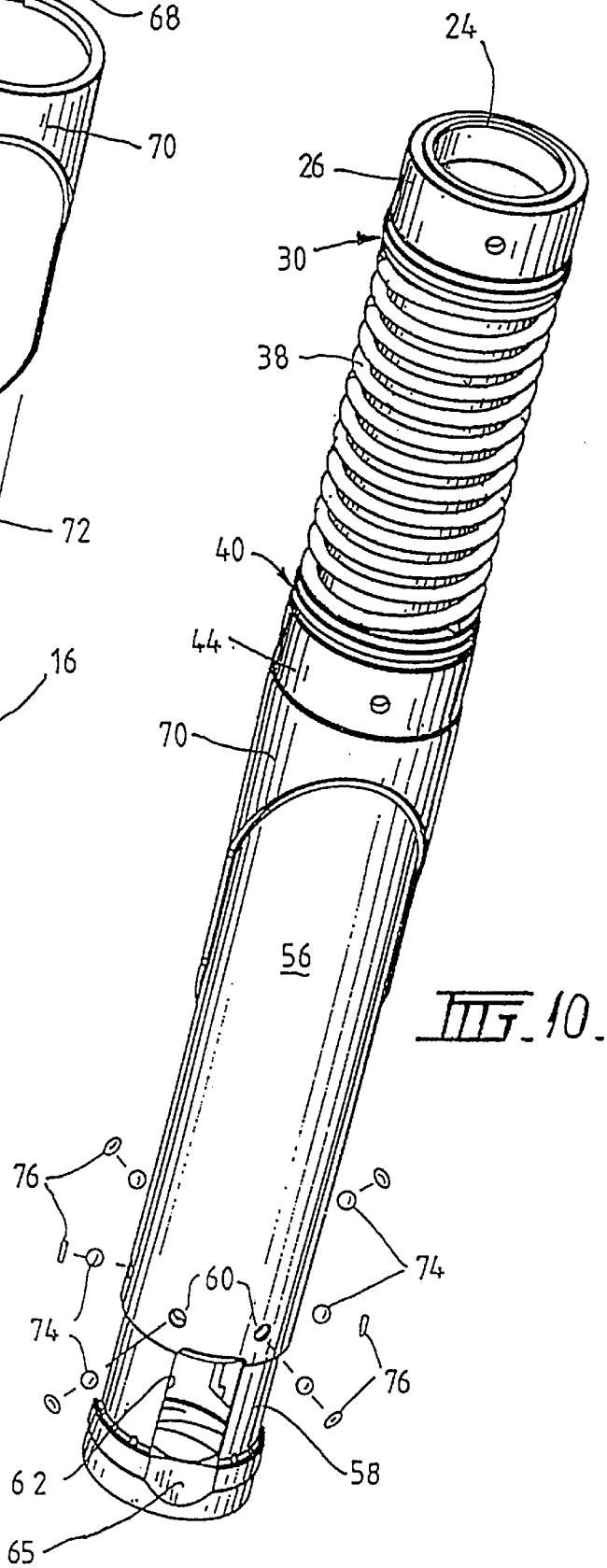

Individual locking balls 74 (FIG. 10) are placed in the holes 60. The balls 74 are prevented from falling through the hole 60 by virtue of the underlying bit lifter case 50, (see for example FIG. 14B). Resilient O-rings 76 are then inserted over the balls in the holes 60 to prevent them from rolling out.

FIGS. 11–13 and 17 illustrate the bit assembly 14 and the method of coupling to the sleeve 16. The bit assembly 14 includes a first cutting means in the form of an annular bit 78 and a second cutting means in the form of bit segments or fingers 80. The annular bit 78 is provided with a depending threaded boss 82 that screws onto the thread 64 on the sleeve 16. Prior to screwing the annular bit 78 onto the sleeve 16 a radially resiliently expandable snap ring 84 is fitted over the end 20 so as to sit about the reduced diameter length 58 of the sleeve 16. The snap ring 84 is dimensioned so that it can slide along the length 58. Each bit finger 80 is provided with a recess 86 (see FIGS. 17A and 17B) extending transversely across an upper end thereof for seating the snap ring 84. One bit finger 80 is provided for each slot 62 in the sleeve 16. A lever 88 is also provided on each finger 80 on the side opposite the recess 86. The lever 88 is located and configured to reside in the groove 52 formed in the core lifter case 50.

Figure 17A:
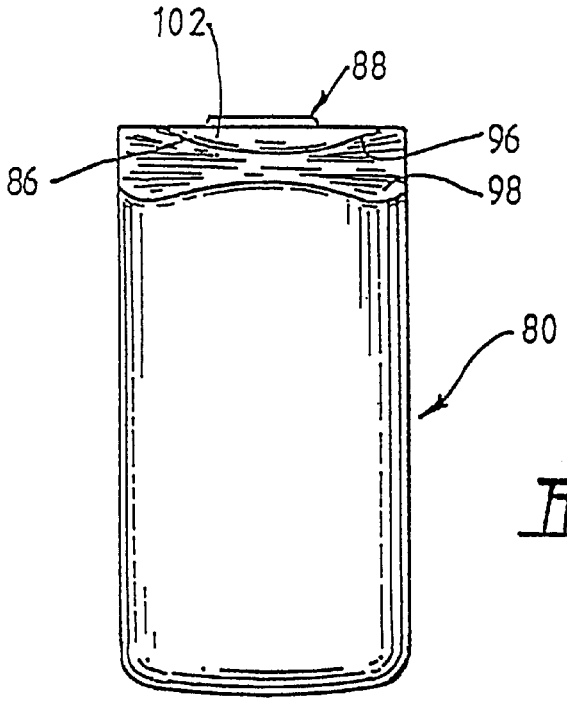
FIGS. 17A and 17B illustrate front, and side views of a drill bit finger used in the system.
Figure 17B:
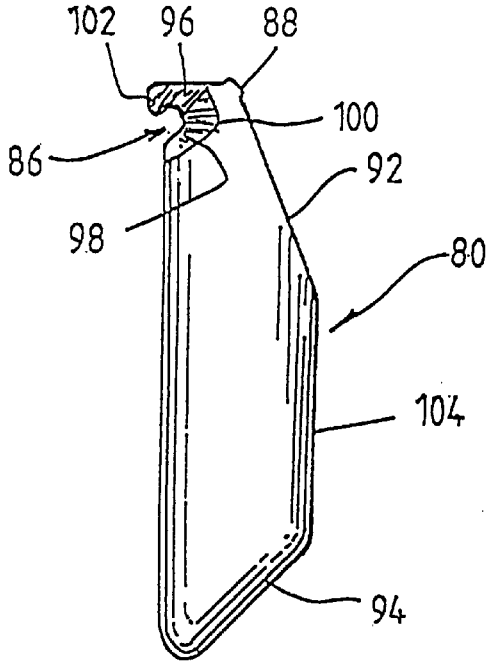

Referring to FIGS. 17A and 17B the fingers 80 are provided with upper and lower tapers 92 and 94 respectively. The tapers 92 and 94 are complimentary to the taper 65. When the bit fingers 80 are in the transport position, shown in FIGS. 13 and 14, they lie longitudinally in the slots 62 with lower taper 94 abutting the taper 65. When the sleeve 16 and transport member 18 slide relative to each other so that their ends 20 and 22 move toward each other the fingers 80 are urged to move outwardly toward the cutting position by virtue of the levers 88 being seated in the groove 52 so that as the end of the groove 52 picks up the levers 88 the fingers 80 are caused to pivot outwardly about the snap ring 84. It will also he understood that the whole assembly of the snap ring 84 and fingers 80 slide along the length 58 as the ends 20 and 22 are being moved closer together. As this occurs the lower tapers 94 of each finger 80 slides along the taper 65 thereby further assisting in the outward pivotal motion of the fingers 80 to the cutting position.

When the sleeve 16 and transport member 18 are slid in an opposite direction so that their ends 20 and 22 move away from each other the groove 52 again picks up the levers 88 urging the fingers 80 to pivot inwardly back to the transport position.

The recess 86 in each finger 80 is provided with first and second regions 96 and 98 that extend transversely along the recess 86 and spaced by a rise 100. The rise 100 is in the form of a shallow convex ridge extending between the regions 96 and 98. An upstanding lip 102 extends part way up in front of the recess 86. The purpose of the lip 102 is to assist in retaining the snap ring 84 within the recess 86. When the fingers 80 are in the transport position, the snap ring 84 rests in the region 98. But when the fingers 80 are being move toward the cutting position, the snap ring 84 snaps over the rise 100 and into the region 96. Likewise when the fingers 80 are returned to the transport position, the snap ring 84 snaps back over rise 100 into the region 98. Diamond matrix (not shown) or other cutting elements are embedded or otherwise supported on the taper 94 and contiguous inside surface 104 of each finger 80 to cut the ground when the fingers 80 are in the cutting position.

Figure 16A:
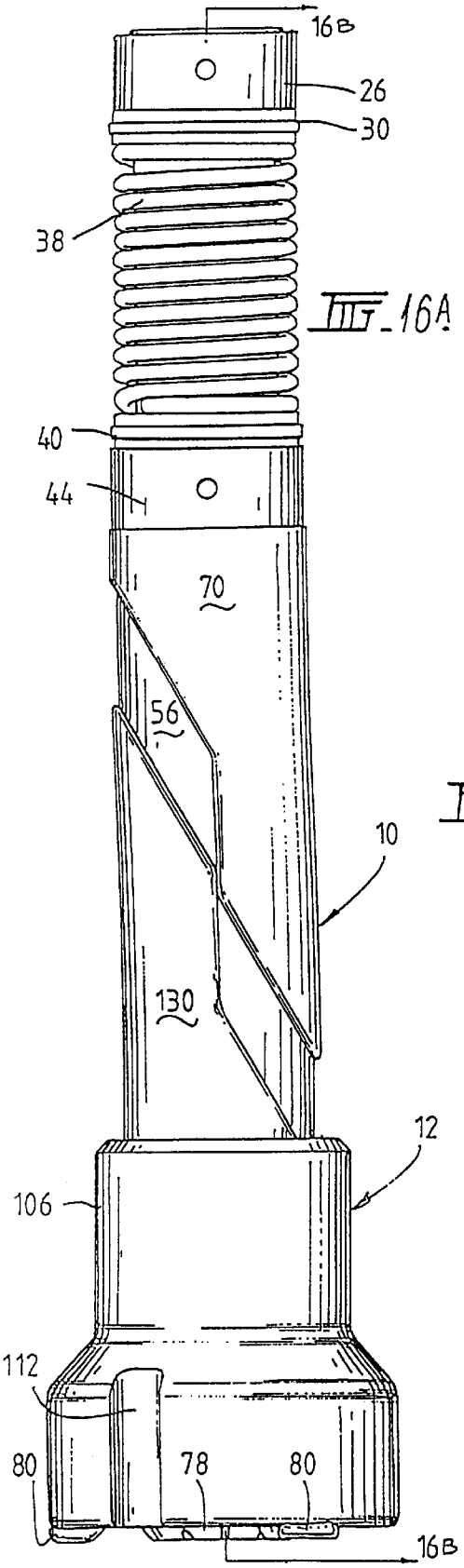
Figure 16B:
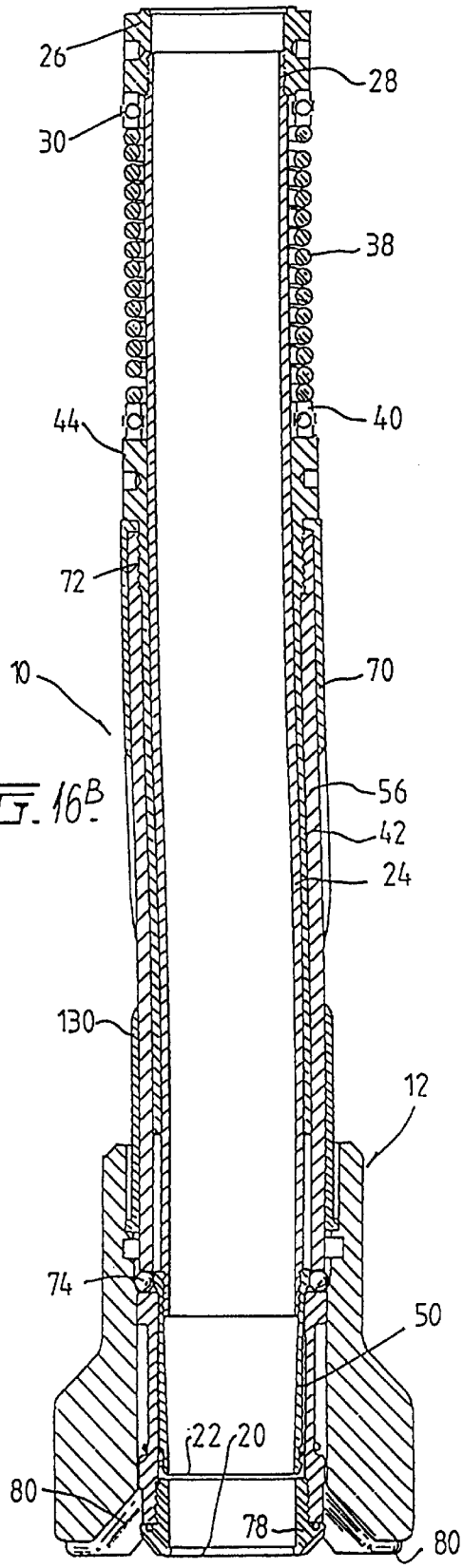
Figure 16C:
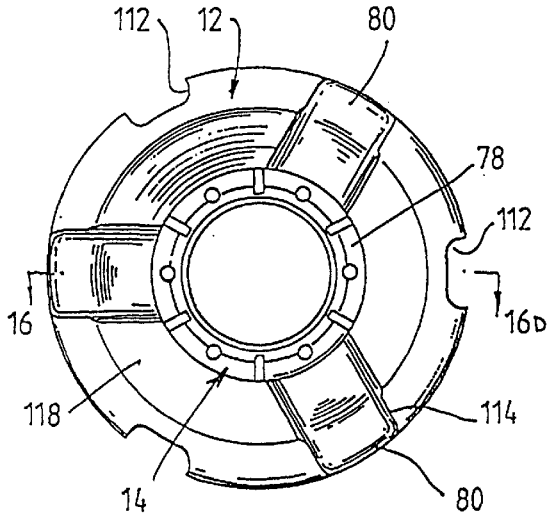
Figure 16D:
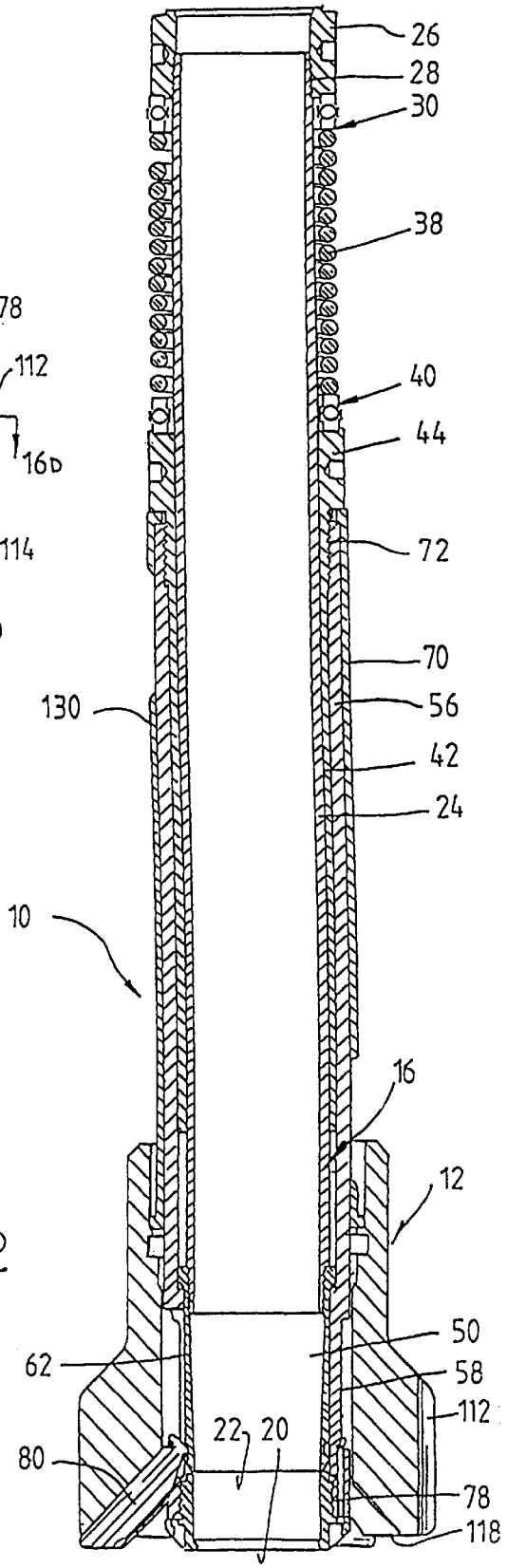
Figure 16E:
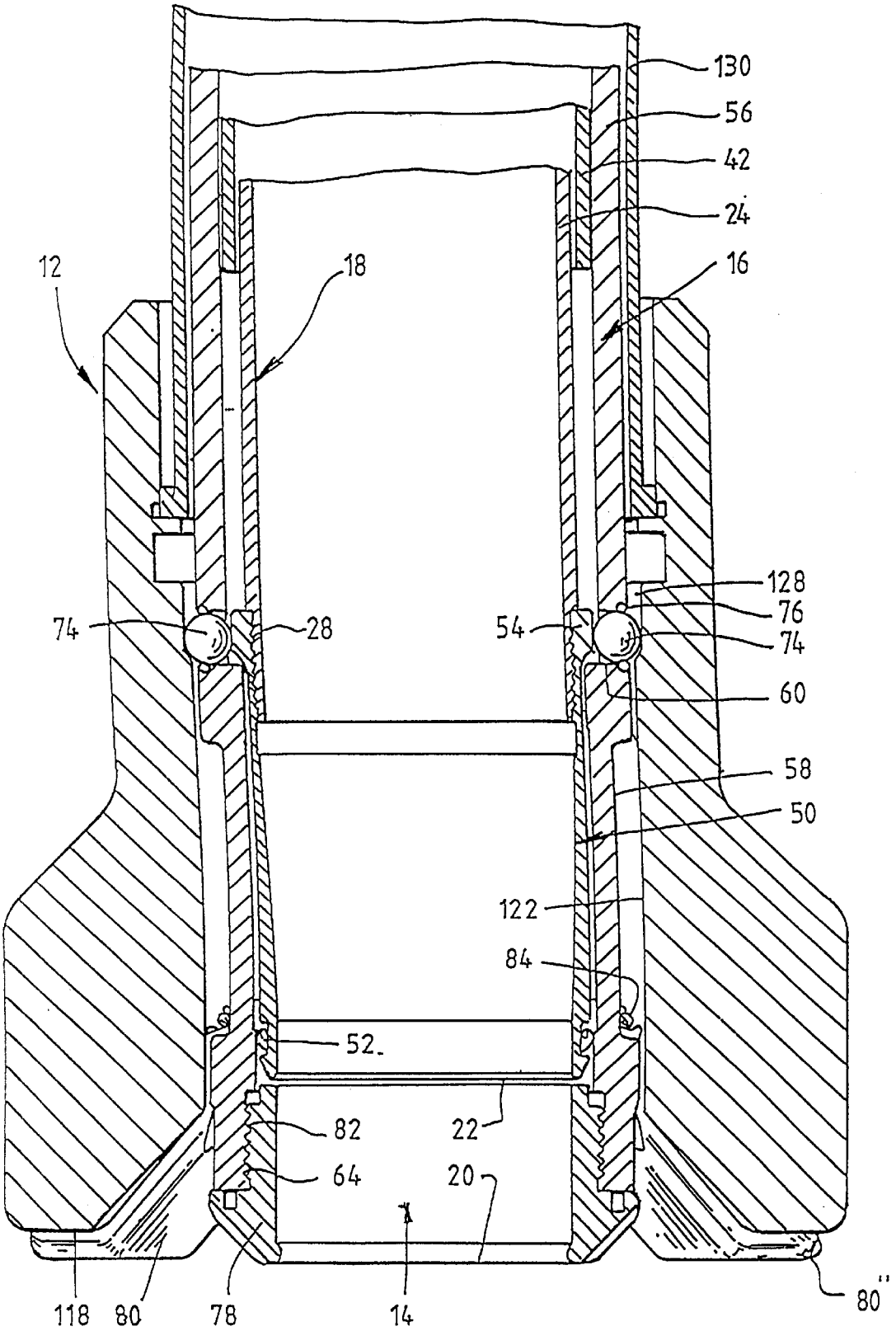
Figure 16F:
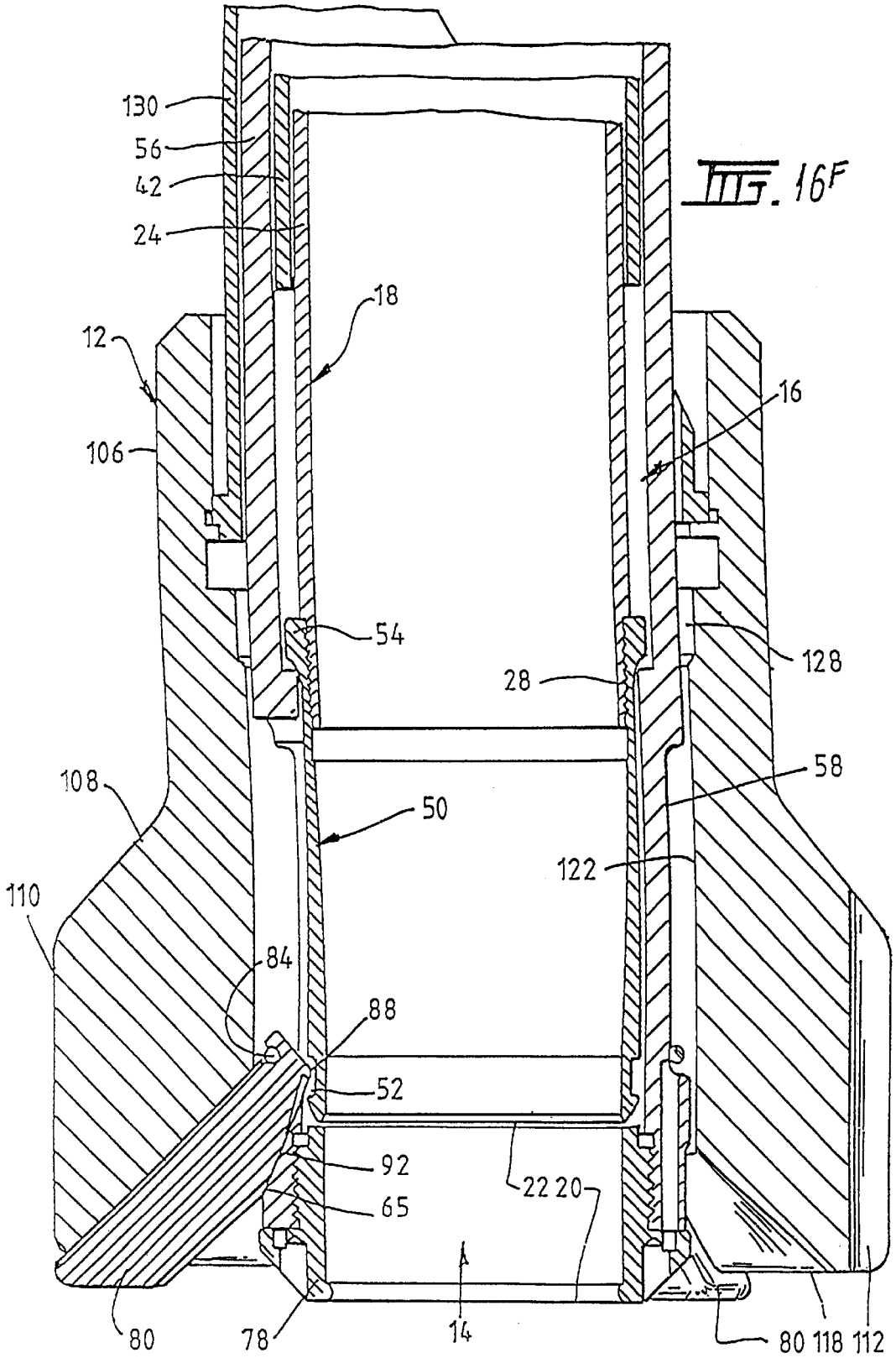

Referring to FIGS. 2 and 14A–14E, the drive sub 12 is in the form of a squat tube having an upper end 106 of a first constant outside diameter a contiguous transitional portion 108 of gradually increasing outside diameter and a lower portion 110 of constant outside diameter. Three evenly spaced channels 112 are cut axially along the outer surface of lower portion 110 and extend part way into the transitional portion 108. The channels 112 are provided to allow for the flow of drilling muds and other fluids to the bottom of the hole being drilled. Three inclined seats 114 are formed in the drive sub 12 for seating respective ones of the fingers 80 as shown in FIG. 16D. The seats 114 are evenly spaced circumferentially about the drive sub 12 and are inclined so that their respective radially outer most ends 116 are adjacent the lower most face 118 of the drive sub 12 with the radially inner most ends 120 of each seat 114 opening onto an inner circumferential surface 122 of a drive sub 12.

Figure 2:
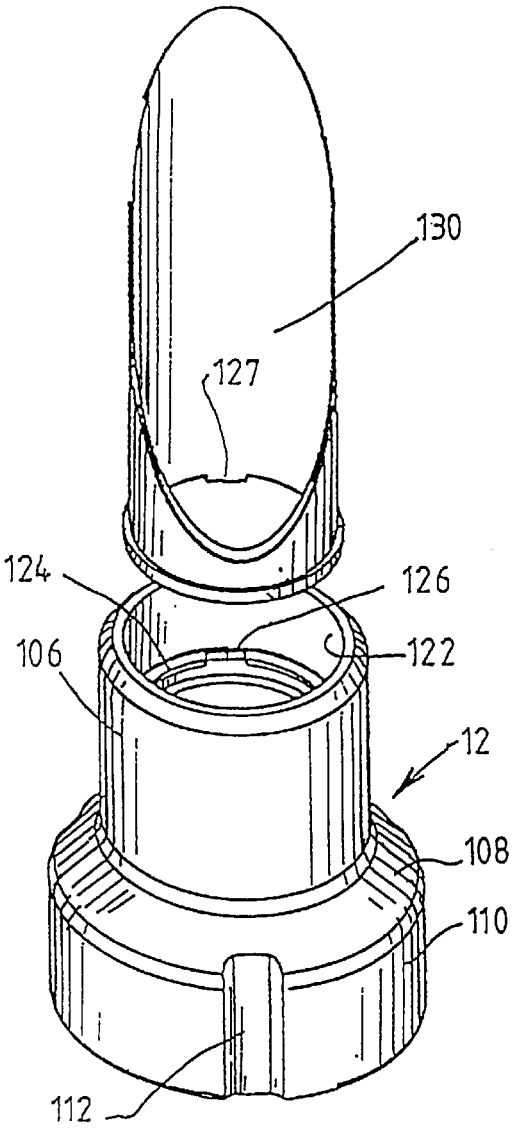
FIG. 2 is a perspective view of a drive sub for use in the system shown in FIG. 1A with an orientation mule shoe.

As shown in FIG. 2 an annular ridge 124 is formed on inside surface 122 of the drive sub 12. A gap 126 is formed in the ridge 124 for receiving a key 127 of a mule shoe 130 that is seating on the ridge 124. A screw thread (not shown) is provided on the inside surface 122 above the ridge 124 to allow the drive sub 12 to be screwed onto the lower end of the drill string.

The operation of the system 10 will now be described with specific reference to FIGS. 1 and 14–16.

Figure 13:
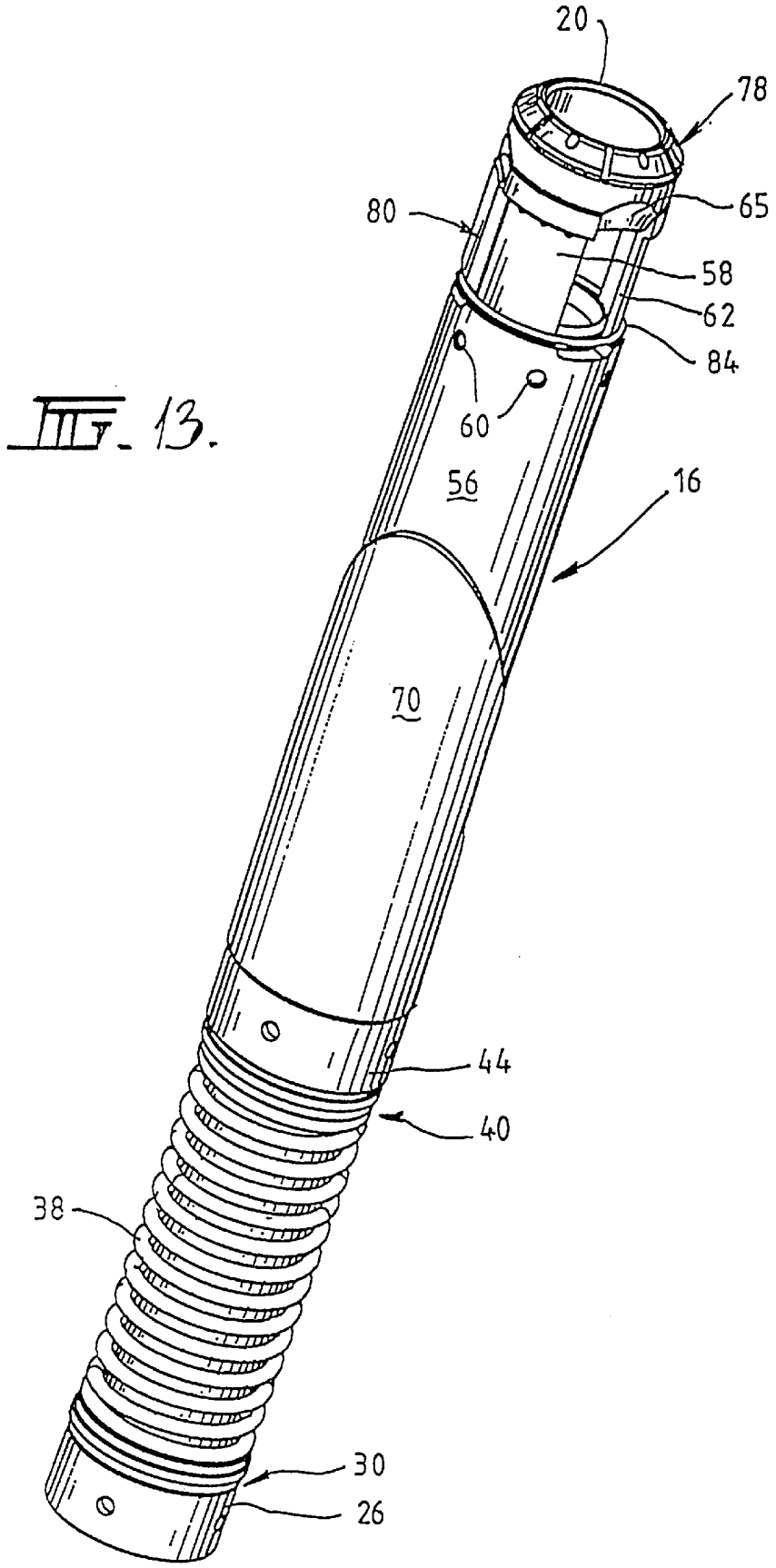

In order to lower the drill bit assembly 14 to the bottom of the ground drill so as to engage the drive sub 12, the assembly 14 is coupled to the bit assembly sleeve 16 which in turn is mounted on the transport sleeve 18 as depicted in FIG. 13. The spring 38 is typically provided with a small preload to ensure that the ends 20 and 22 are at their maximum distance apart and that the fingers 80 are maintained in the transport position. A further inner core tube (not shown) is screwed onto the adaptor ring 26. The further inner core tube incorporates the conventional back end of a core barrel as described hereinabove and the total ensemble is lowered through the ground drill in a conventional manner eg by a wire-line. Eventually, as the transport sleeve 18 nears the bottom of the drill string the mule shoes 70 and 130 come into contact. Unless by chance the peaks on the mule shoes 70 and 130 are exactly opposite each other, the contact of the mule shoes will force the transport member 18 to rotate about its longitudinal axis as a transport member 18 continues to move downwardly. This ensures that the transport member 18 is orientated so that the fingers 80 expand into the seats 114.

Downward motion of the bit sleeve assembly 16 is halted when the mule shoes 70 and 130 are in diametrically opposed orientations. In this position, as shown in FIGS. 14A–14E, the lower most end 20 of the sleeve 16 extends below the lower face 118 of the drive sub 12. The ground drill is lifted off the bottom of the hole by a sufficient distance so that the lower end 20 does not touch the bottom of the hole while this is occurring.

Although the downward motion of the sleeve 16 is halted by mutual abutment of the mule shoes 70 and 130, the transport member 18 continues to move a short distance downwardly compressing the spring 38. This movement is brought about by the action of gravity although, it can be also assisted by the pumping of mud or fluids down the hole. It will also be appreciated that this downward movement results in the lower end 22 of the transport member 18 moving toward the lower end 20. As this occurs, the levers 88 of the fingers 80 are picked up by the groove 52 in the core lifter case 50 thereby pivoting the fingers 80 outwardly about the snap ring 84, as depicted in FIGS. 15A–15F. Simultaneously, the snap ring 84 and the fingers 80 slide a short distance along the length 58 of the sleeve 16. The downward motion of the transport member 18 continues until it reaches a predetermined location at which it releasably locks into the ground drill.

In order to fully expand the fingers 80 into a cutting position, the ground drill is then lowered onto the bottom of the hole. As this occurs, lower end 20 is effectively pushed backwards by the weight of the drill string further compressing the spring 38. However transport member 18 is largely prohibited from moving backward as it is locked into the ground drill. Thus, lower end 20 is forced toward lower end 22. Accordingly, the sleeve 16 slides inside the fingers 80 so that the tapers 65 at the end of each slot 62 eventually comes into contact with a corresponding finger 80. Depending on the initial degree of spread of the fingers 80 this initial contact may be made either on the lower taper 94 of each finger 80 but more likely on the surface 104. The backward sliding motion continues until the taper 65 of each slot bears against the tapering 92 of the corresponding finger. In this position, the fingers 80 are fully spread into the cutting position and located in respective seats 114, (see FIGS. 16A–16F).

Drilling may now commence by applying torque to the drill string at the ground end. Torque is transferred from the drive sub 12 to the annular bits 78 via the fingers 80. This arises because the end of the fingers 80 containing the upper taper 92 is at all times held within respective slots 62 in the sleeve 16.

If the system 10 is used in land based drilling, the weight of the drill string itself will ensure that the spring 38 remains compressed and the fingers 80 are held in the cutting position during drilling. A releasable locking system is provided to ensure that the drill bit assembly 14 remains in the cutting, position during drilling even if the ground drill is lifted from the bottom of the hole which may occur if drilling, from a floating platform or a boat due to wave or tide action.

The locking system comprises the balls 74, outer circumferential surface of the core lifted case 50 and an annular groove 128 formed on the inside surface 122 of the drive sub 12.

Figure 14A:
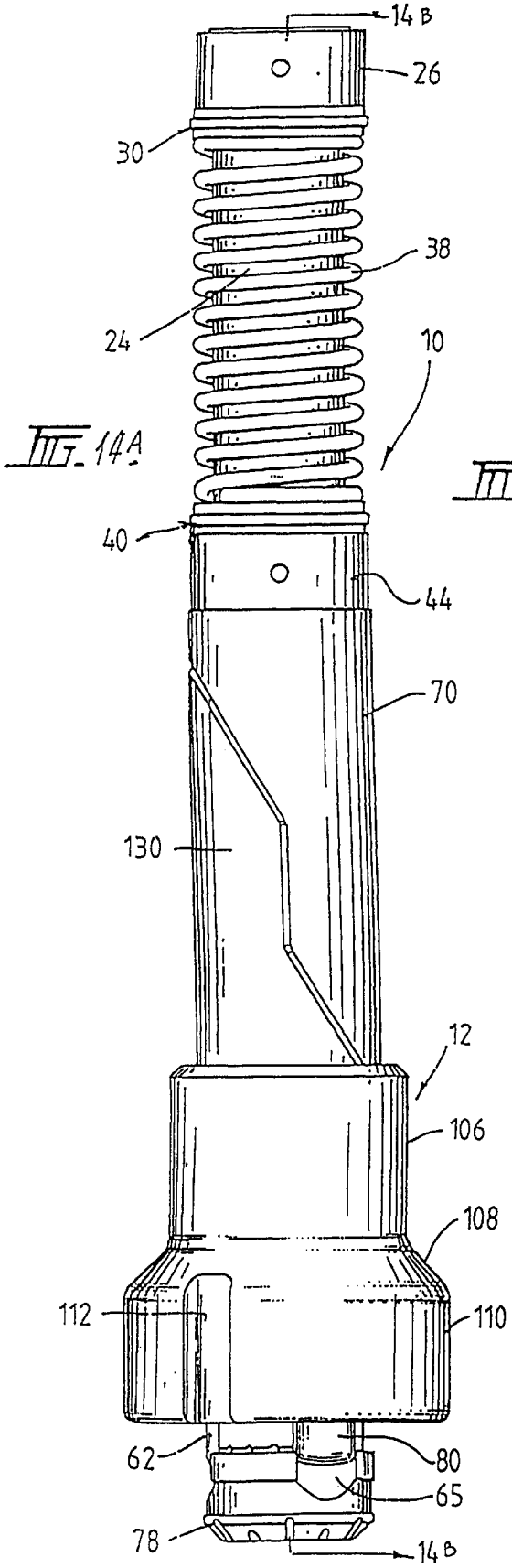
Figure 14B:
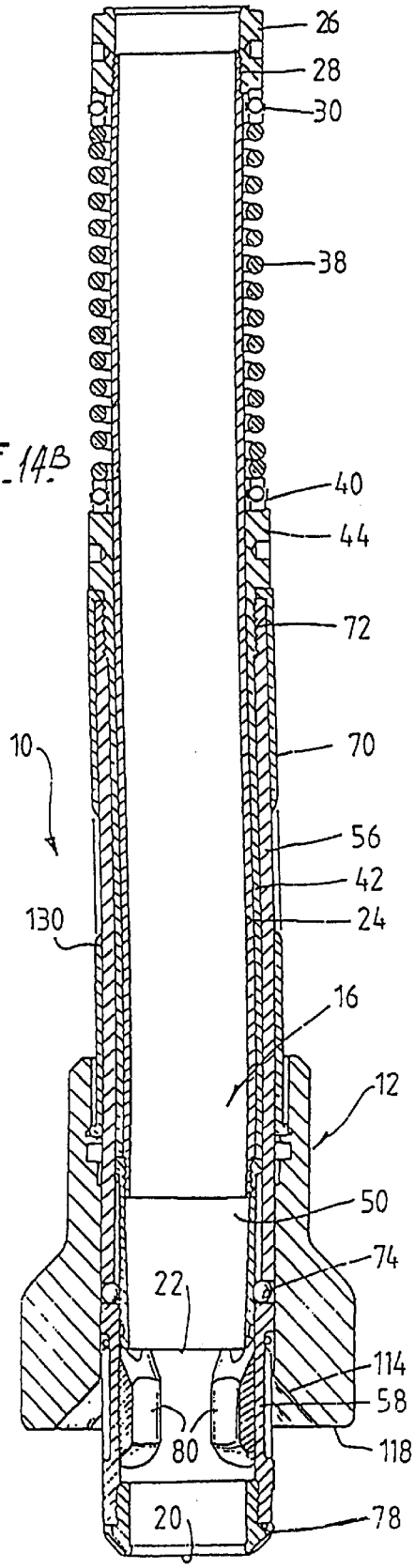
Figure 14C:
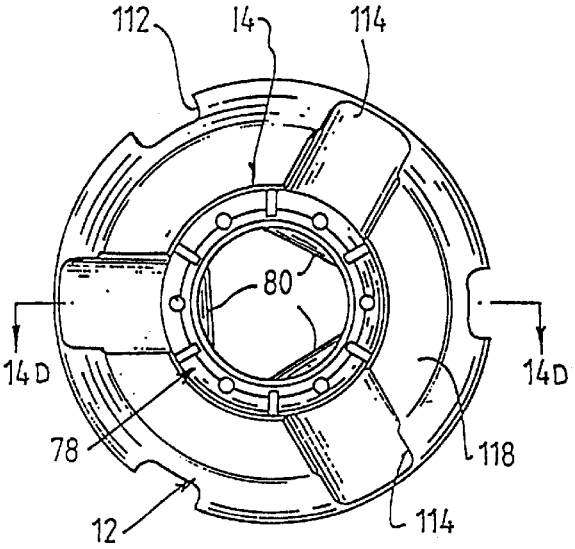
Figure 14D:
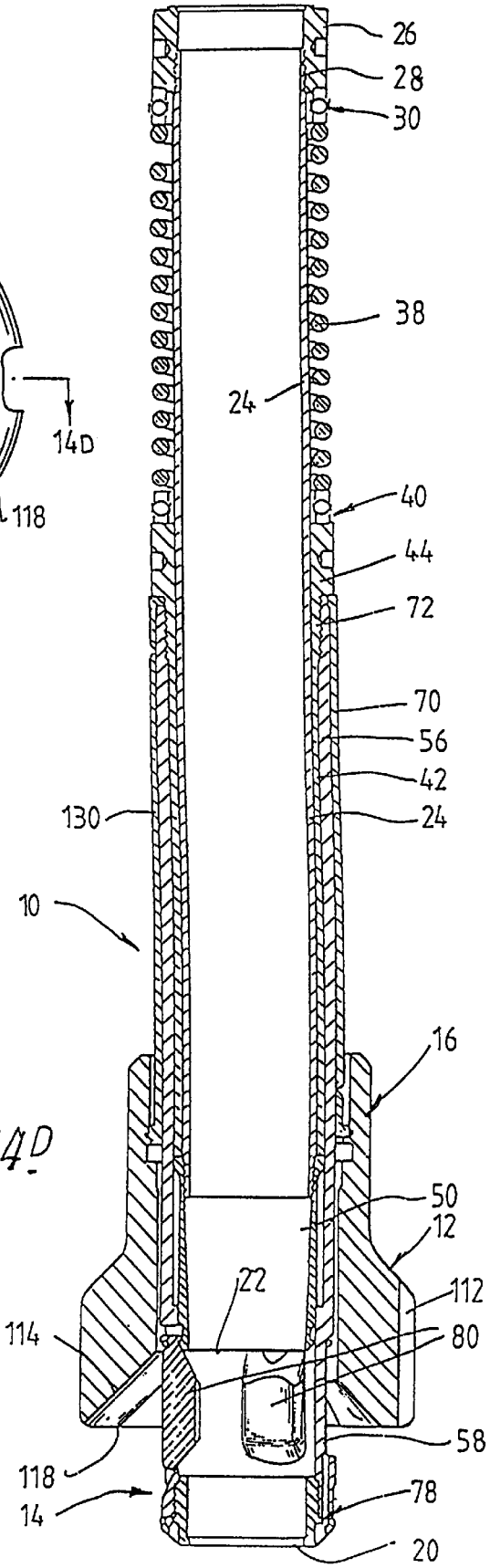
Figure 14E:
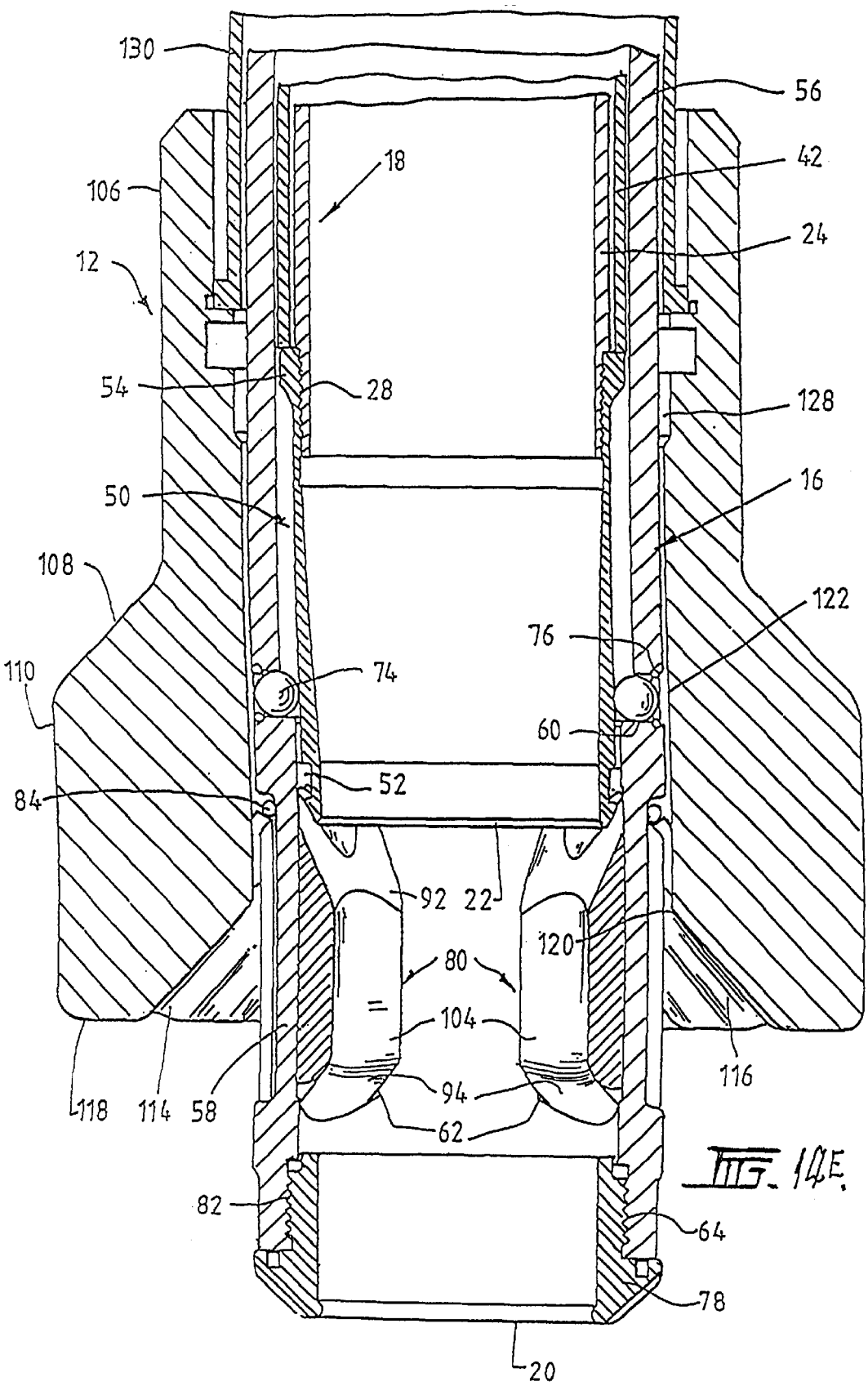
Figure 15A:
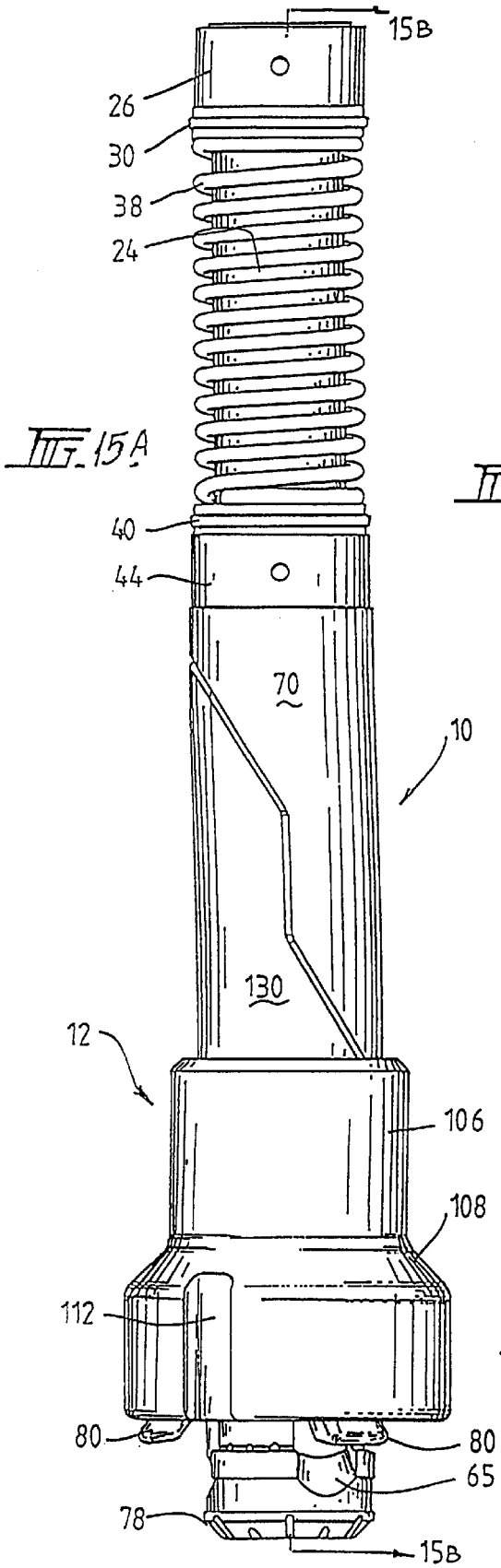
Figure 15B:
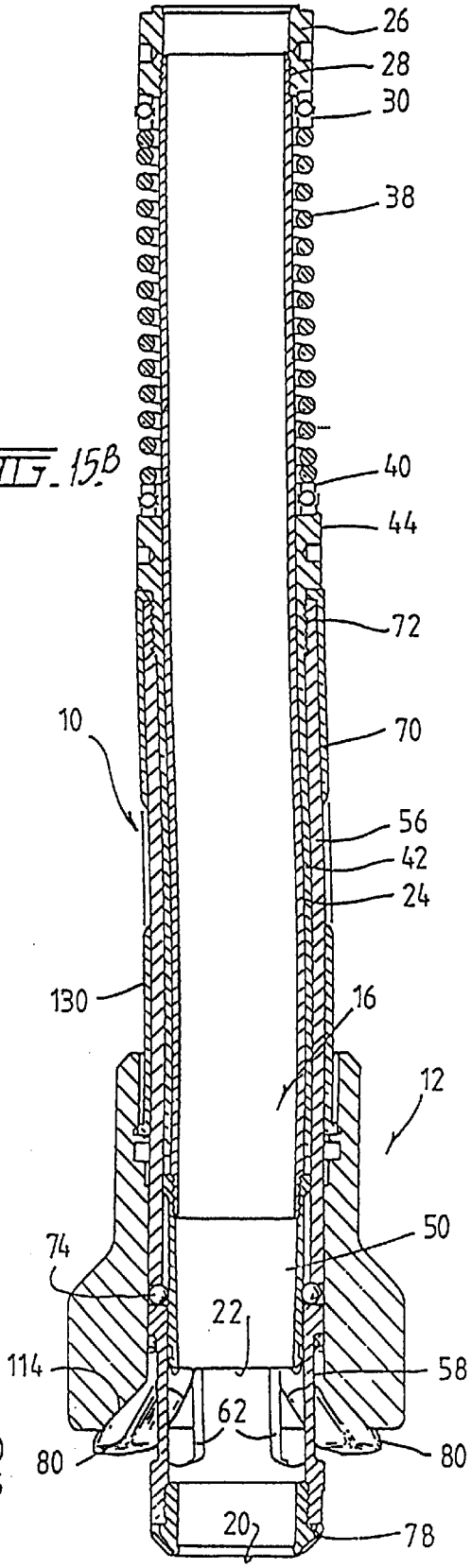
Figure 15C:
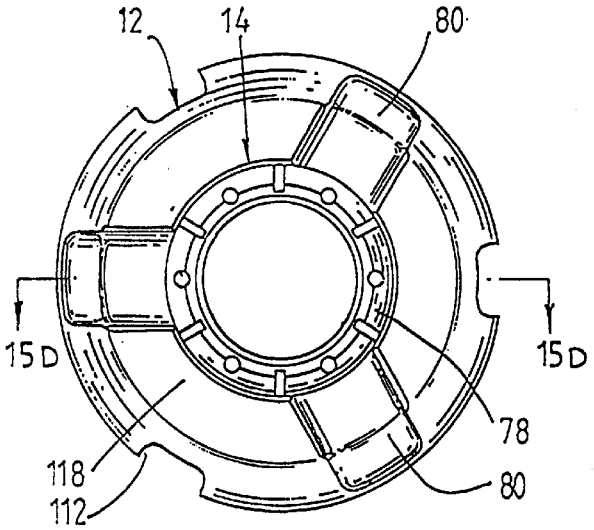
Figure 15D:
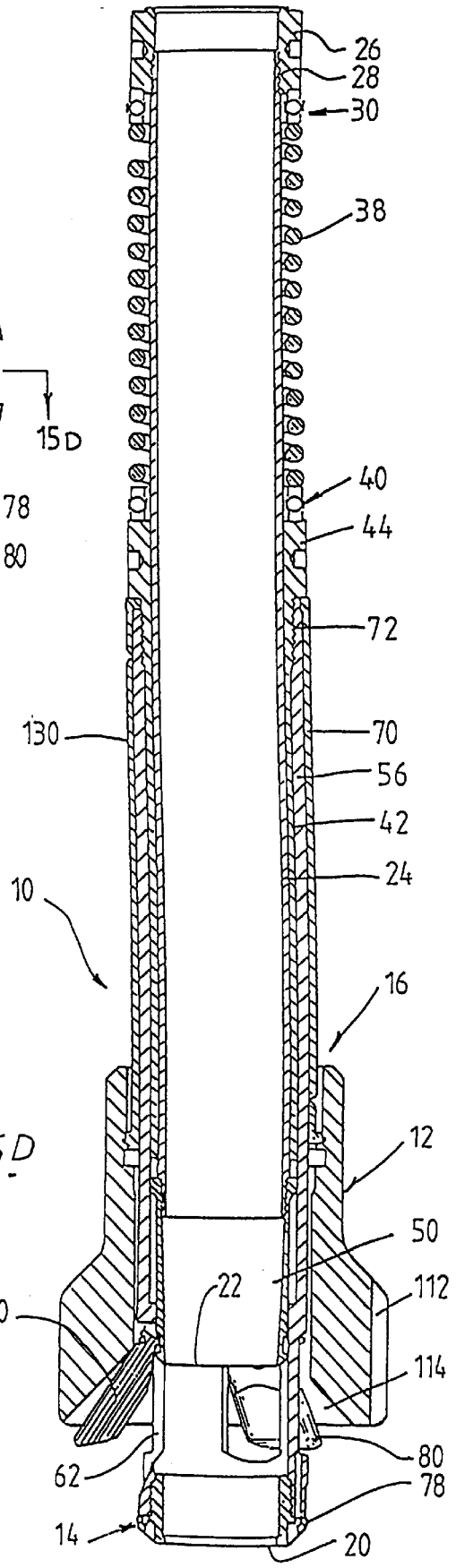
Figure 15E:
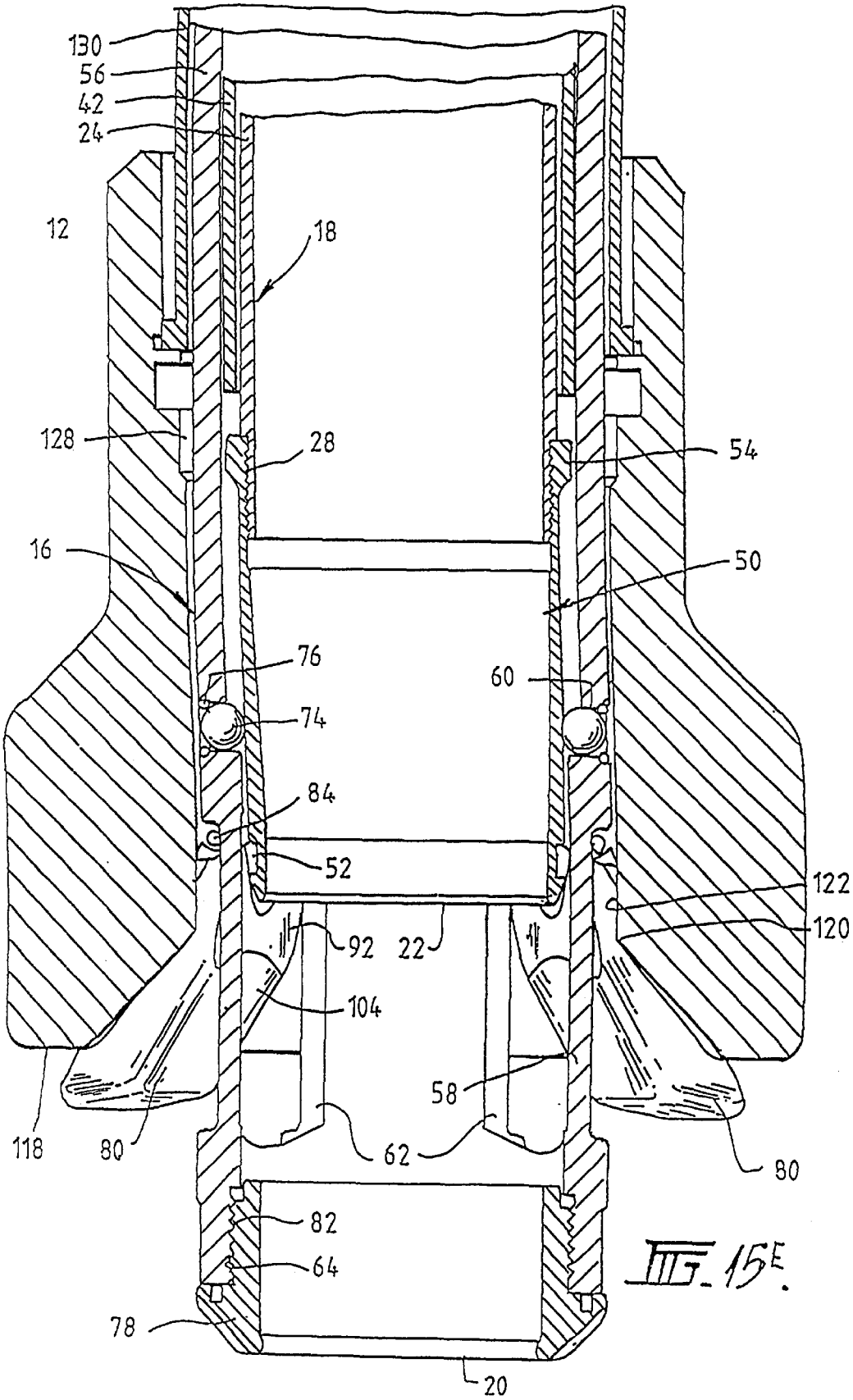
Figure 15F:
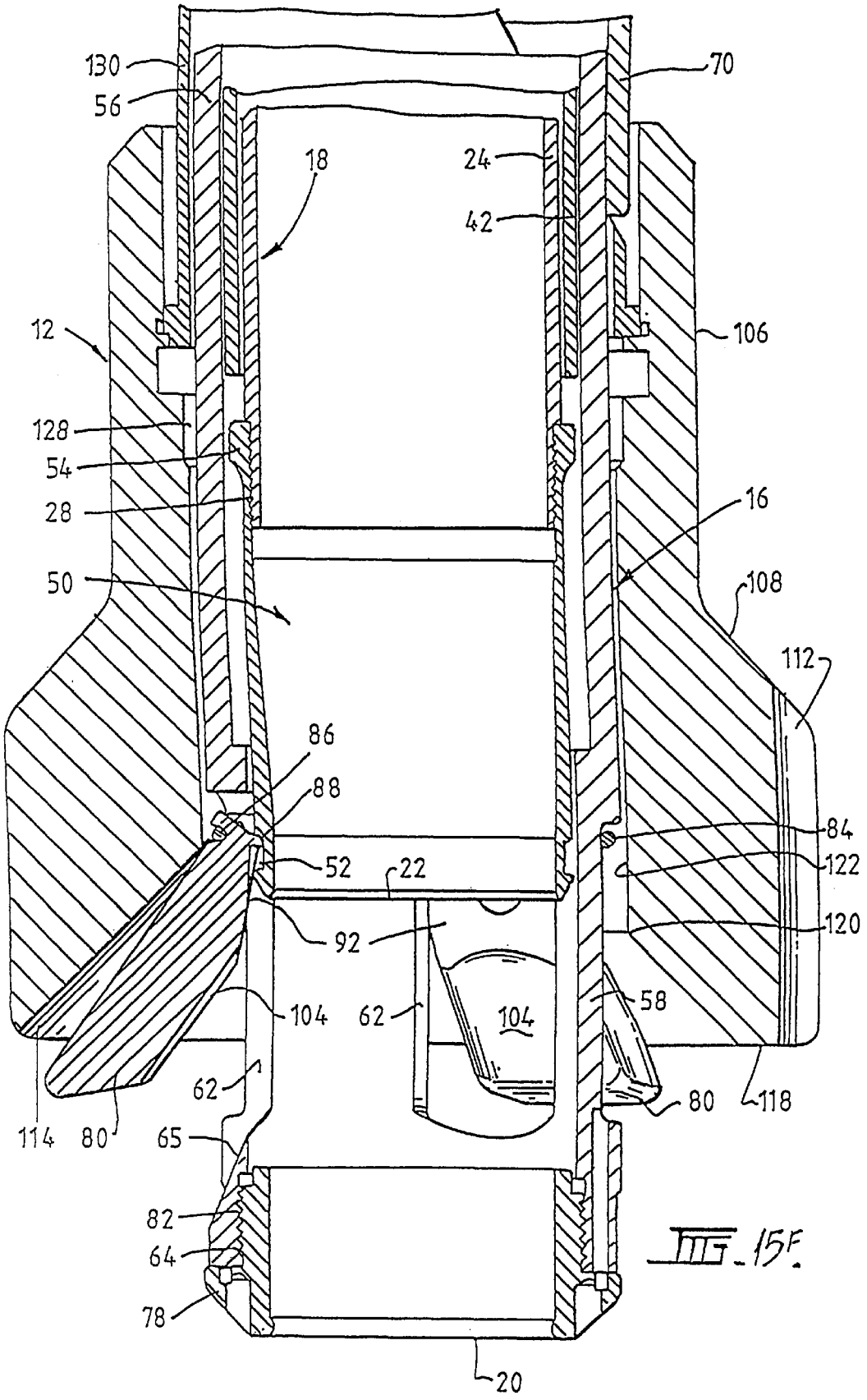

When the system 10 is in the equilibrium position shown in FIGS. 13 and 14B the locking balls 74 are located toward a lower end of the core lifter case 50. As the end 20 and 22 move toward each other when the drill bit assembly 14 is moving from the transport position to the cutting position, the locking balls 74 roll or slide upwardly along the outside surface of the core lifter case 50 toward the lip 54. When the transport member 18 is locked in place the lip 54 is located opposite the groove 128. At this time, as shown in FIG. 15B the lock balls 74 are located below the lip 54 and groove 128. Now as the ground drill is lowered onto the bottom of the hole to fully spread the fingers 80 into the cutting position the locking balls 74 are pushed upwardly along the core lifter case 50 to the lip 54. When they reach the lip, they push the transport sleeve 18 upwardly a short distance by compressing the rubber shut off valves described above. This compression is brought about because in effect the whole weight of the ground drill is being applied to the rubber shut off valves via the sleeve 16 and balls 74. With this short upward movement of the transport member 18 the balls 74 can now ride up the lip 54 and locate in the groove 128 as shown in FIG. 16B. When this occurs, the compressive force on the rubber shut off valves is released thereby allowing them to expand again and pushing the transport member 18 down a short distance so that the balls 74 are now trapped between the outer circumferential surface of the lip 54 and the groove 128. Now, if the whole of the ground drill is lifted from the bottom of the hole the spring 38 is locked in compression and the drill bit assembly 14 is maintained in the cutting position.

When it is desired to change the drill bit assembly 14, the drill is stopped and lifted a short distance off the bottom of the hole. A wire line is then lowered through the ground drill in a conventional manner and engages a standard spear head assembly (not shown) coupled at the upper end of the transport member 18. In a conventional manner, the transport member 18 is unlocked from the ground drill and is pulled up by winding in the wire line. As the transport member is moved upwardly, the lip 54 is pulled upwardly away from the contact with the locking balls 74. The balls 74 can now move radially inwardly onto the outer surface of the core lifter case 50 thereby releasing the bit assembly sleeve 16 from the drive sub 12. The spring 38 is now able to expand to its equilibrium condition to force the ends 20 and 22 away from each other. In effect, the release of the spring 38 fires the sleeve 16 downwardly relative to the transport member 18. As this occurs the levers 88 are caught in the groove 52 pulling the fingers 80 upwardly along the length 58 pivoting them inwardly about snap ring 84 so that they again locate in their respective slots 62 with the snap ring snapping over rise 100 into region 96 of the recess 86 in each finger 80. The system 10 is now fully disengaged from the drive sub 12 and ground drill and is pulled to the surface via the wire line. The annular bit 78 and bit fingers 80 can now be removed from the sleeve 16 and replaced with a fresh drill bit assembly 14 which can then be lowered down the ground drill and locked into the cutting position as described above.

When the drill bit assembly 14 is in the cutting position and drilling occurs, it is important to appreciate that the load on the drill bit assembly 14 ie the fingers 80 and annular bits 78 is transferred and carried by the drive sub 12 and the core lifter case 50. No load is placed on the inner core tube 24. This enables the system 10 to be used with conventional inner core tubes without any modification being required thereto. The inner core tube 24 simply acts to transport the drill bit assembly 14 to and from the drive sub 12 rather than have any load bearing capability or function.

The fingers 80 are prevented from sliding inwardly along seats 114 by mutual abutment of the taper 65 on the sleeve 16 with taper 92 on the fingers 80. This produces a wedging effect limiting the inward motion of the fingers 80 along seats 114 thereby protecting the lower end 22 for transport member 18 being crushed.

Torque applied to the sleeve 16 is decoupled from the transport member 18 (and inner tube 24) by the bearing assemblies 30 and 40 and the intervening spring 38. Rotation of the inner core tube 24 should be minimised in order to reduce wearing of the outer diameter of the core being drilled which may adversely effect the operation of the core lifter case 50.

Now that an embodiment of the present invention has been described in detail it will be apparent to those skilled in the relevant arts that numerous modifications and variations may be made without departing from the basic inventive concepts. For example, the annular bit 78 may be a full face bit, and the drill bit assembly 14 can be in the form of a roller cone or a PCD. Also, while three fingers 80 are shown different numbers can be used. In order to assist in preventing inwardly sliding motion of the fingers 80 along seats 114 during drilling by the provision of buttons or short posts on the seats 114 which engage in corresponding recesses formed in the fingers 80. Also, while lip 102 is shown in the drawings to assist in locating and maintaining the fingers 80 on the snap ring 84, a demountable mechanism such as a flat head bolt or screw can be used. All such modifications and variations together with others that will be apparent to those of ordinary skill in the art are deemed to be within the scope of the present invention the nature of which is to be determined from the above description and the appended claims.

What is claimed is:

1. A retractable drill bit system for a ground drill having a drive sub attached to a lower end thereof, the system including:

a drill bit assembly engagable with the drive sub for cutting a hole, the drill bit assembly expandable and collapsible between a transport position in which the drill bit assembly is transportable through the ground drill and a cutting position in which the drill bit assembly is engaged in the drive sub and positioned to cut said hole;

a bit assembly sleeve having a lower end coupled to the drill bit assembly; and a transport member arranged coaxially with and extending inside the bit assembly sleeve with the lower end of the sleeve extending beyond a lower end of the transport member, the transport member and sleeve resiliently coupled together to allow relative linear sliding motion therebetween, the transport member adapted for lowering into and retrieval from the ground drill and releasably lockable to the ground drill when the transport member reaches a predetermined location within the ground drill;

the drill bit assembly operatively associated with the bit assembly sleeve and the transport member such that linear motion of the respective lower ends of the sleeve and transport member toward each other urges the drill bit assembly toward the cutting position and linear motion of the lower ends away from each other urges the drill bit assembly toward the transport position;

wherein the drill bit assembly is transportable in the transport position through the ground drill to the drive sub and, upon the transport member reaching the predetermined location, said lower ends of the sleeve and member are moved toward each other to expand the drill bit assembly to the cutting position and into engagement with the drill sub to enable drilling to proceed, and wherein the drill bit assembly is collapsed to the transport position by pulling upwardly on the transport member causing the lower ends to move away from each other to enable the drill bit assembly to be retrieved with the transport member.

2. A retractable drill bit system according to claim 1 wherein the sleeve is of a length so that, with the ground drill lifted off the bottom of a hole being drilled, the lower end of the sleeve extends below the drive sub when the transport member is in the predetermined location, such that, upon lowering the ground drill to the bottom of the hole, the sleeve is forced backwards relative to transport member resulting in the lower ends of the sleeve and member being moved toward each other and expanding the drill bit assembly to the cutting position and into engagement with the drill sub.

3. A retractable drill bit system according to claim 1 further including stop means acting between the sleeve and the ground drill to stop motion of the sleeve toward the drive sub prior to the transport member reaching the predetermined location so that continued motion of the transport member toward the predetermined location causes the lower ends of the sleeve and member to move toward each other initiating expansion of the drill bit assembly toward the cutting position.

4. A retractable drill bit system according to claim 3 wherein said stop means is a mule shoe which further acts to axially position the transport member so that the drill bit assembly locates in seats formed in the drive sub.

5. A retractable drill bit system according to claim 1 wherein the drill bit assembly includes a first cutting means of a fixed diameter attached to the lower end of the sleeve and second cutting means selectively expandable and collapsible between the transport position and cutting position.

6. A retractable drill bit system according to claim 5 wherein said second cutting means includes a plurality of bit fingers coupled to the bit assembly sleeve and engaging the transport member so that relative linear motion of the lower ends of the sleeve and member towards each other urges the drill bit assembly into the cutting position and relative linear motion of said ends of the sleeve and transport member away from each other urges the drill bit assembly into the transport position.

7. A retractable drill bit system according to claim 6 wherein the second cutting means is coupled to the bit assembly sleeve by a resiliently radially expandable ring located about a reduced diameter portion of the bit assembly sleeve such that the ring and the second cutting means can slide along said reduced diameter portion when said bit assembly sleeve and transport member slide relative to each other.

8. A retractable drill bit system according to claim 7 wherein each finger is provided with a recess for seating said ring.

9. A retractable drill bit system according to claim 8 wherein each recess is provided with first and second regions spaced by a rise such that the ring is located in the first region when the second cutting means are in the transport position and the ring can snap over the rise into the second region and when the second cutting means is expanding to the cutting position.

10. A retractable drill bit system according to claim 9 wherein each finger is provided with a lever formed on the side of each finger opposite the recess, the lever engaging the transport member so that linear motion of the transport member relative to the bit assembly sleeve can urge the fingers to pivot between the cutting position and the transport position.

11. A retractable drill bit system according to claim 5 wherein the second cutting means and the bit assembly sleeve are provided with complimentary inclined surfaces that abut when the second cutting means is in the cutting position, said complimentary inclined surfaces configured so that forces acting inwardly along the length of the fingers during drilling tend to wedge the fingers between the drive sub and the bit assembly sleeve.

12. A retractable drill bit system according to claim 5 wherein the sleeve and transport member are resiliently coupled by a spring that is in a state of compression when the drill bit assembly is in the cutting position and acts to urge the lower ends of the bit assembly sleeve and the transport member to move away from each other and thus the drill bit assembly into the transport position.

13. A retractable drill bit system according to claim 12 further including means for releasably locking the spring in the compressed state when the drill bit assembly is in the cutting position.

14. A retractable drill bit system according to claim 13 wherein said means for releasably locking the spring includes one or more locking balls carried in the bit assembly sleeve and a raised lip formed circumferentially about an outer circumferential surface of the transport member wherein when the transport member is locked at said predetermined position said lip is located opposite a recess formed on an inner circumferential surface of the drive sub so that as the bit assembly sleeve is pushed towards the transport member by a lowering of the ground drill onto the bottom of the hole being drilled the balls roll or slide along the transport member and abut the raised lip momentarily pushing the transport member upwardly so that the balls can ride over the raised lip and partially locate in the recess and against the lip to hold said bit assembly sleeve in position and said spring in the compressed state.

15. A retractable drill bit system according to claim 14 wherein said transport member comprises a standard inner core tube and a core lifter case coupled at a lower end of the inner core tube, with said lip formed on the outer circumferential surface of the core lifter case.

* * * * *